US010667034B2

(12) United States Patent
Asada et al.

(10) Patent No.: US 10,667,034 B2
(45) **Date of Patent: *May 26, 2020**

(54) SIGNAL PROCESSING DEVICE, SIGNAL PROCESSING METHOD, AND PROGRAM

(71) Applicant: Sony Corporation, Tokyo (JP)

(72) Inventors: Kohei Asada, Kanagawa (JP); Yushi Yamabe, Tokyo (JP); Shigetoshi Hayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/354,710

(22) Filed: Mar. 15, 2019

(65) Prior Publication Data

US 2019/0215598 A1 Jul. 11, 2019

Related U.S. Application Data

(63) Continuation of application No. 15/565,524, filed as application No. PCT/JP2016/056504 on Mar. 2, 2016, now Pat. No. 10,349,163.

(30) Foreign Application Priority Data

Apr. 17, 2015 (JP) ..... 2015-084817

(51) Int. Cl.
*H04R 1/10* (2006.01)
*G10K 11/178* (2006.01)
(Continued)

(52) U.S. Cl.
CPC ..... *H04R 1/1091* (2013.01); *G10K 11/17837* (2018.01); *G10K 11/17881* (2018.01);
(Continued)

(58) Field of Classification Search
None
See application file for complete search history.

(56) References Cited

U.S. PATENT DOCUMENTS 7,072,476 B2 7/2006 White et al.
8,208,644 B2 6/2012 Goldstein et al.
(Continued)

FOREIGN PATENT DOCUMENTS

EP 1970901 A2 9/2008
GB 2437772 A 11/2007
(Continued)

OTHER PUBLICATIONS

European Communication Pursuant to Rule 164(1) EPC dated Nov. 20, 2018 in connection with European Application No. 16779832.1.
(Continued)

*Primary Examiner* — Qin Zhu
(74) *Attorney, Agent, or Firm* — Wolf, Greenfield & Sacks, P.C.

(57) ABSTRACT

[Object] To allow a listener to listen to ambient sounds of the external environment in an appropriate manner while wearing a head mounted acoustic device.
[Solution] Provided is a signal processing device including a first acquiring unit configured to acquire a sound collection result for a first sound propagating in an external space, a second acquiring unit configured to acquire a sound collection result for a second sound propagating in an internal space, a first filter processing unit configured to generate a difference signal which is substantially equal to a difference between the first sound propagating directly from the external space toward the inside of the external ear canal and the first sound propagating from the external space to the internal space via the mounting unit on the basis of the sound collection result for the first sound, a subtracting unit configured to generate a subtraction signal obtained by subtract-
(Continued)

ing a first signal component based on the sound collection result for the first sound and a second signal component based on an input acoustic signal from the sound collection result for the second sound, a second filter processing unit configured to generate a noise reduction signal based on the subtraction signal, and an adding unit configured to add the difference signal and the noise reduction signal to the input acoustic signal and generate a drive signal.

6 Claims, 16 Drawing Sheets

(51) Int. Cl.
*H04R 1/22* (2006.01)
*G10L 21/0208* (2013.01)
*H04R 3/04* (2006.01)

(52) U.S. Cl.
CPC ..... *G10L 21/0208* (2013.01); *H04R 1/1083* (2013.01); *H04R 1/22* (2013.01); *H04R 3/04* (2013.01); *G10K 2210/1081* (2013.01); *G10K 2210/3014* (2013.01)

(56) References Cited

U.S. PATENT DOCUMENTS

| | | | | |
|---|---|---|---|---|
| 8,526,628 | B1 * | 9/2013 | Massie | G10K 11/178 381/71.1 |
| 2008/0101622 | A1 | 5/2008 | Sugiyama | |
| 2008/0181419 | A1 | 7/2008 | Goldstein et al. | |
| 2008/0186218 | A1 | 8/2008 | Ohkuri et al. | |
| 2008/0247560 | A1 | 10/2008 | Fukuda et al. | |
| 2008/0310645 | A1 * | 12/2008 | Itabashi | H04R 1/1083 381/71.6 |
| 2009/0147966 | A1 | 6/2009 | McIntosh et al. | |
| 2009/0323976 | A1 | 12/2009 | Asada et al. | |
| 2010/0195842 | A1 | 8/2010 | Sibbald | |
| 2013/0114821 | A1 | 5/2013 | Hamalainen | |
| 2014/0126733 | A1 * | 5/2014 | Gauger, Jr. | H04R 1/1083 381/71.6 |
| 2014/0126756 | A1 | 5/2014 | Gauger, Jr. | |
| 2014/0219462 | A1 | 8/2014 | Usher et al. | |
| 2014/0341387 | A1 * | 11/2014 | Gauger, Jr. | H04R 3/002 381/71.6 |
| 2015/0271602 | A1 | 9/2015 | Gauger, Jr. | |
| 2016/0241948 | A1 * | 8/2016 | Liu | H04M 1/19 |
| 2018/0115818 | A1 | 4/2018 | Asada et al. | |

FOREIGN PATENT DOCUMENTS

| | | | |
|---|---|---|---|
| GB | 2492983 | A | 1/2013 |
| JP | 2008-193421 | A | 8/2008 |
| JP | 4882773 | B2 | 2/2012 |
| WO | WO 2014/070995 | A1 | 5/2014 |
| WO | WO 2014/071013 | A1 | 5/2014 |

OTHER PUBLICATIONS

International Search Report and Written Opinion and English translation thereof dated May 24, 2016 in connection with International Application No. PCT/JP2016/056504.
International Preliminary Report on Patentability and English translation thereof dated Oct. 26, 2017 in connection with International Application No. PCT/JP2016/056504.
Extended European Search Report dated Feb. 27, 2019 in connection with European Application No. 16779832.1.
Extended European Search Report dated Jan. 24, 2020 in connection with European Application No. 19196604.3.

* cited by examiner

SIGNAL PROCESSING DEVICE, SIGNAL PROCESSING METHOD, AND PROGRAM

CROSS-REFERENCE TO RELATED APPLICATIONS

This application is a continuation of and claims the benefit under 35 U.S.C. § 120 of U.S. patent application Ser. No. 15/565,524, titled "SIGNAL PROCESSING DEVICE, SIGNAL PROCESSING METHOD, AND PROGRAM," filed Oct. 10, 2017, which is a National Stage of International Application No. PCT/JP2016/056504, filed in the Japanese Patent Office as a Receiving office on Mar. 2, 2016, which claims priority to Japanese Patent Application Number 2015-084817, filed in the Japanese Patent Office on Apr. 17, 2015, each of which is hereby incorporated by reference in its entirety.

TECHNICAL FIELD

The present disclosure relates to a signal processing device, a signal processing method, and a program.

BACKGROUND ART

In recent years, as acoustic devices which are worn on heads of users for use such as earphones or headphones (which may hereinafter be referred to as "head mounted acoustic devices"), in addition to devices that simply output acoustic information, devices with functions in which use situations are considered have become widespread. As a specific example, a head mounted acoustic device capable of suppressing ambient sounds (so-called noise) coming from an external environment and enhancing a sound insulation effect using a so-called noise canceling technique is known. Patent Literature 1 discloses an example of an acoustic device using such a noise canceling technique.

CITATION LIST

Patent Literature

Patent Literature 1: JP 4882773B

DISCLOSURE OF INVENTION

Technical Problem

Meanwhile, as information processing devices which are configured to be carried by users such as so-called smartphones, tablet terminals, and wearable terminals have become more widespread, use situations of the head mounted acoustic devices are no longer limited to listening to so-called audio content but have been further diversified.

With the diversification of the use situations, desirable use situations in which listeners (users) are able to listen to ambient sounds coming from the external environment while wearing head mounted acoustic devices can be considered as well.

In this regard, the present disclosure proposes a signal processing device, a signal processing method, and a program, which are capable of enabling a listener to listen to ambient sounds of the external environment in an appropriate manner while wearing a head mounted acoustic device.

Solution to Problem

According to the present disclosure, there is provided a signal processing device, including: a first acquiring unit configured to acquire a sound collection result for a first sound propagating in an external space outside a mounting unit to be worn on an ear of a listener; a second acquiring unit configured to acquire a sound collection result for a second sound propagating in an internal space connected with an external ear canal inside the mounting unit; a first filter processing unit configured to generate a difference signal which is substantially equal to a difference between the first sound propagating directly from the external space toward an inside of the external ear canal and the first sound propagating from the external space to the internal space via the mounting unit on the basis of the sound collection result for the first sound; a subtracting unit configured to generate a subtraction signal obtained by subtracting a first signal component based on the sound collection result for the first sound and a second signal component based on an input acoustic signal to be output from an acoustic device from an inside of the mounting unit toward the internal space from the sound collection result for the second sound; a second filter processing unit configured to generate a noise reduction signal for reducing the subtraction signal on the basis of the subtraction signal; and an adding unit configured to add the difference signal and the noise reduction signal to the input acoustic signal to generate a drive signal for driving the acoustic device.

Further, according to the present disclosure, there is provided a signal processing method, including, by a processor: acquiring a sound collection result for a first sound propagating in an external space outside a mounting unit to be worn on an ear of a listener; acquiring a sound collection result for a second sound propagating in an internal space connected with an external ear canal inside the mounting unit; generating a difference signal which is substantially equal to a difference between the first sound propagating directly from the external space toward an inside of the external ear canal and the first sound propagating from the external space to the internal space via the mounting unit on the basis of the sound collection result for the first sound; generating a subtraction signal obtained by subtracting a first signal component based on the sound collection result for the first sound and a second signal component based on an input acoustic signal to be output from an acoustic device from an inside of the mounting unit toward the internal space from the sound collection result for the second sound; generating a noise reduction signal for reducing the subtraction signal on the basis of the subtraction signal; and adding the difference signal and the noise reduction signal to the input acoustic signal and to generate a drive signal for driving the acoustic device.

Further, according to the present disclosure, there is provided a program causing a computer to execute: acquiring a sound collection result for a first sound propagating in an external space outside a mounting unit to be worn on an ear of a listener; acquiring a sound collection result for a second sound propagating in an internal space connected with an external ear canal inside the mounting unit; generating a difference signal which is substantially equal to a difference between the first sound propagating directly from the external space toward an inside of the external ear canal and the first sound propagating from the external space to the internal space via the mounting unit on the basis of the sound collection result for the first sound; generating a subtraction signal obtained by subtracting a first signal component based on the sound collection result for the first sound and a second signal component based on an input acoustic signal to be output from an acoustic device from an inside of the mounting unit toward the internal space from the sound collection result for the second sound; generating a noise reduction signal for reducing the subtraction signal on the basis of the subtraction signal; and adding the difference signal and the noise reduction signal to the input acoustic signal and to generate a drive signal for driving the acoustic device.

Advantageous Effects of Invention

As described above, according to the present disclosure, a signal processing device, a signal processing method, and a program, which are capable of enabling a listener to listen to the ambient sounds of the external environment in an appropriate manner while wearing a head mounted acoustic device are provided.

Note that the effects described above are not necessarily limitative. With or in the place of the above effects, there may be achieved any one of the effects described in this specification or other effects that may be grasped from this specification.

MODE(S) FOR CARRYING OUT THE INVENTION

Figure 1:
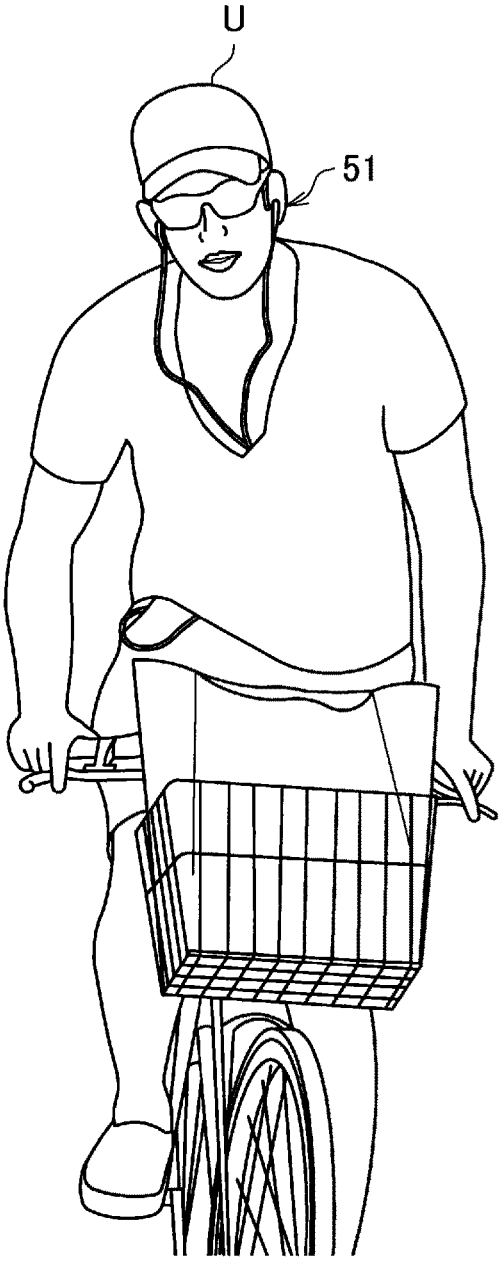
FIG. 1 is an explanatory diagram for describing an application example of a head mounted acoustic device to which a signal processing device according to an embodiment of the present disclosure is applied.

Hereinafter, (a) preferred embodiment(s) of the present disclosure will be described in detail with reference to the appended drawings. In this specification and the appended drawings, structural elements that have substantially the same function and structure are denoted with the same reference numerals, and repeated explanation of these structural elements is omitted.

The description will proceed in the following order.

1. Overview
2. Principle for implementing hear-through effect
2.1. Overview
2.2. Basic functional configuration
3. First Embodiment
4. Second Embodiment
4.1. Schematic functional configuration
4.2. Configuration example for reducing delay amount
4.3. Modified example
4.4. Conclusion
5. Third Embodiment
6. Hardware configuration
7. Conclusion <1. Overview>

In order to facilitate understanding of characteristics of a signal processing device related to the present disclosure, first, an application example of a head mounted acoustic device such as an earphone or a headphone to which the signal processing device can be applied will be described, and then a problem of the signal processing device according to the present disclosure will be described.

As the head mounted acoustic devices such as earphones or headphones which are worn on the heads of the users when used, in addition to devices that simply output acoustic information, devices with functions in which use situations are considered have become widespread. As a specific example, a head mounted acoustic device capable of suppressing ambient sounds (so-called noise) coming from an external environment and enhancing a sound insulation effect using a so-called noise canceling technique is known.

Meanwhile, as information processing devices which are configured to be carried by users such as so-called smartphones, tablet terminals, and wearable terminals have become widespread, the use situations of head mounted acoustic devices are no longer limited to listening to so-called audio content but have been further diversified.

For example, in recent years, user interfaces (UIs) that enable users to recognize notification information without checking a screen or the like when an information processing device reads out the information by voice through a speech synthesis technology have become widespread. As another example, interactive UIs based on voice input that enable users to operate information processing devices by interacting with the devices by voice by applying a voice recognition technique have also become widespread.

In order to cause such a UI to be usable even in so-called public places, a situation in which the user constantly wears a head mounted acoustic device is also considered. For example, FIG. 1 is an explanatory diagram for describing an application example of a head mounted acoustic device to which a signal processing device according to an embodiment of the present disclosure is applied. In other words, FIG. 1 illustrates an example of a situation in which the user uses a portable information processing device such as a smartphone while wearing a head mounted acoustic device 51 in a so-called public place such as a case in which the user goes out.

As described above, there are cases in which it is desirable for the user to be able to hear so-called ambient sounds coming from an external environment in addition to acoustic information (for example, audio content) output from the information processing device while constantly wearing the head mounted acoustic device 51. In these cases, it is more preferable for the user to be able to hear the ambient sounds coming from the external environment in a manner similar to that in a case in which the user does not wear the head mounted acoustic device 51.

In the following description, a state in which the user is able to hear a so-called ambient sound coming from an external environment even while the user is wearing the head mounted acoustic device 51 in a manner similar to that in a case in which the user does not wear the head mounted acoustic device 51 is also referred to as a "hear-through state." Similarly, an effect of enabling the user to hear a so-called ambient sound coming from an external environment even while the user is wearing the head mounted acoustic device in a manner similar to that in a case in which the user does not wear the head mounted acoustic device 51 is also referred to as a "hear-through effect."

If the hear-through state described above is implemented, for example, the user is able to check a sound output indicating notification of content of e-mails or news while checking a surrounding situation and wearing the head mounted acoustic device even in a public place. As another example, the user is also able to perform a phone call with another user by means of a so-called phone call function while checking a surrounding situation in motion.

On the other hand, in order to cause the user to experience a more natural hear-through effect, a technique based on the premise of the use of a head mounted acoustic device having high hermeticity (in other words, a high shielding property against the external environment) such as a so-called canal type earphone is important. This is because there are cases in which, in a situation in which a head mounted acoustic device having relatively low hermeticity such as a so-called open air headphone is used, influence of so-called sound leakage is large, and use in public places is not necessarily preferable.

On the other hand, in situations in which a head mounted acoustic device having high hermeticity such as a canal type earphone is used, ambient sounds coming from an external environment which leak into the ear (the so-called external ear canal) of the user via the head mounted acoustic device are at least partially shielded. Therefore, the user is likely to hear ambient sounds coming from an external environment in different manner from the state in which the user does not wear the head mounted acoustic device, or the user may hardly hear the ambient sounds.

In this regard, in the present disclosure, an example of a technique for implementing the hear-through state described above in a situation in which a head mounted acoustic device having high hermeticity such as a so-called canal type earphone is used will be described.

<2. Principle For Implementing Hear-Through Effect>

[2.1. Overview]

First, an example of a principle for implementing the hear-through effect will be described in comparison with an example of a so-called feed-forward (FF) type noise canceling (NC) earphone (or headphone). For example, FIG. 2 is an explanatory diagram for describing an example of the principle for implementing the hear-through effect and illustrates an example of a schematic functional configuration of the head mounted acoustic device 51 in a case in which the head mounted acoustic device 51 is configured as a so-called FF type NC earphone.

Figure 2:
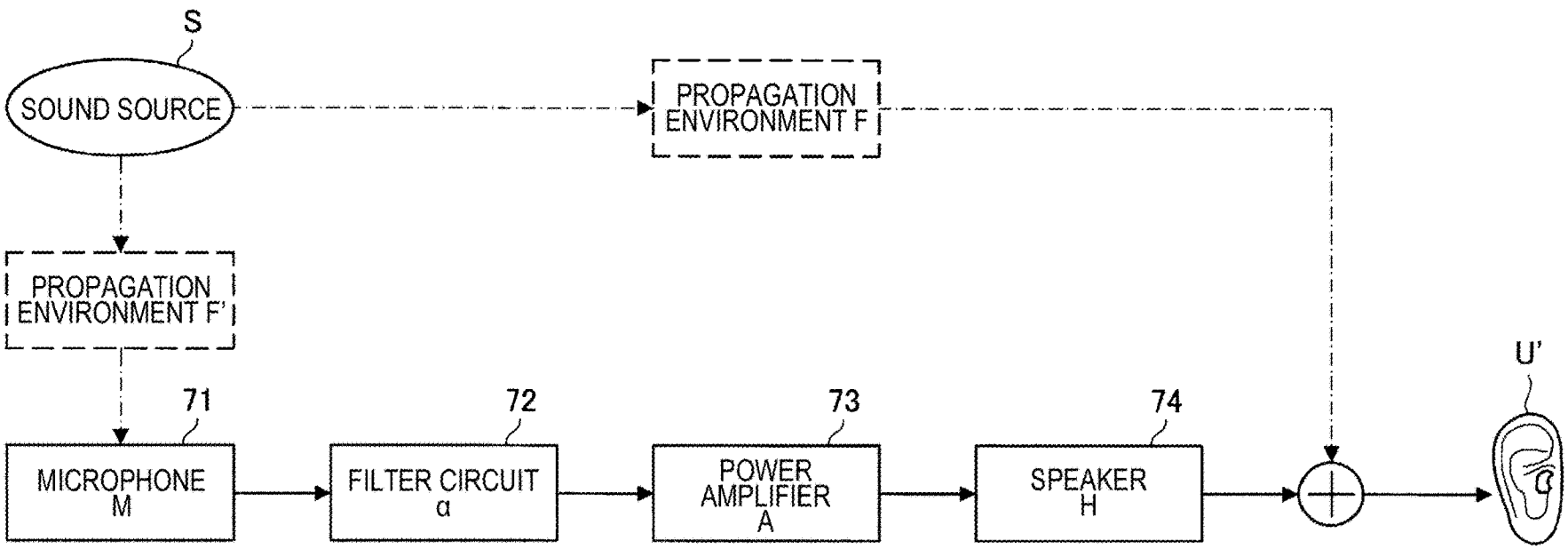
FIG. 2 is an explanatory diagram for describing an example of a principle for implementing a hear-through effect.

As illustrated in FIG. 2, the head mounted acoustic device 51 includes, for example, a microphone 71, a filter circuit 72, a power amplifier 73, and a speaker 74. In FIG. 2, reference numeral F schematically indicates a transfer function of a propagation environment before a sound N from a sound source S reaches (that is, leaks into) the user's ear (that is, the inside of the external ear canal) via the housing of the head mounted acoustic device 51. Reference numeral F' schematically indicates the transfer function of the propagation environment before the sound N from the sound source S reaches the microphone 71.

Figure 3:
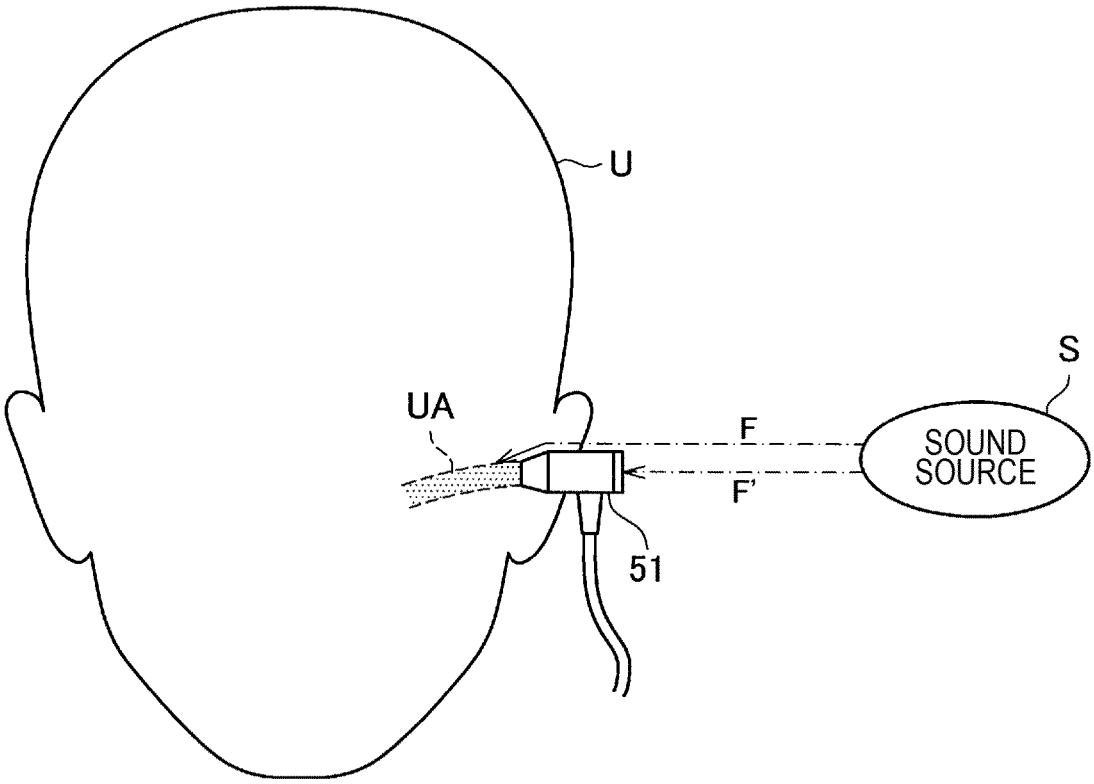
FIG. 3 is a diagram schematically illustrating an example of a propagation environment before an ambient sound is heard by a user in a case in which the user wears a canal type earphone.

Here, FIG. 3 is referred to. FIG. 3 schematically illustrates an example of the propagation environment before the sound N from the sound source S is heard by the user U in a case in which the user U wears a so-called canal type earphone as the head mounted acoustic device 51. In FIG. 3, reference numeral UA schematically indicates a space in the external ear canal of a user U (hereinafter also referred to simply as an "external ear canal"). Further, reference numerals F and F' in FIG. 3 correspond to reference numerals F and F' illustrated in FIG. 2, respectively. In the following description, as illustrated in FIG. 3, when the head mounted acoustic device 51 is worn on the ear of the user U, a space connected to the external ear canal UA inside the head mounted acoustic device 51 is also referred to as an "internal space." Further, when the head mounted acoustic device 51 is worn on the ear of the user U, a space outside the head mounted acoustic device 51 is also referred to as an "external space."

As illustrated in FIGS. 2 and 3, the sound N from the sound source S propagating via the propagation environment F N may leak into the ear U' of the user (specifically, the internal space connected to the external ear canal UA). Therefore, in the NC earphone, the influence of the sound N is mitigated by adding a signal having a reverse phase (a noise reduction signal) to the sound N propagating via the propagation environment F.

Specifically, for example, the sound N from the sound source S of the external environment reaches the microphone 71 via the propagation environment F' and is collected by the microphone 71. The filter circuit 72 generates a signal having a reverse phase (noise reduction signal) to that of the sound N propagating via the propagation environment F on the basis of the sound N collected by the microphone 71. The noise reduction signal generated by the filter circuit 72 undergoes gain adjustment performed by the power amplifier 73 and is then output toward the ear U' of the user through the speaker 74. Accordingly, a component of the sound N propagating to the ear U' of the user via the propagation environment F is canceled by a component of the noise reduction signal output from the speaker 74, and the sound N is suppressed.

Here, transfer functions based on device characteristics of the microphone 71, the power amplifier 73, and the speaker 74 are indicated by M, A, and H, respectively. Further, a filter coefficient when the filter circuit 72 generates the noise reduction signal on the basis of an acoustic signal collected by the microphone 71 is indicated by α. At this time, in the NC earphone, so-called noise canceling is implemented by designing the filter coefficient α of the filter circuit 72 so that a relational expression indicated by (Formula 1) below is satisfied.

[Math. 1]

$$F'AHM\alpha N+FN\approx 0 \quad \text{(Formula 1)}$$

On the other hand, in the hear-through state, as illustrated in FIG. 3, in the state in which the head mounted acoustic device 51 is worn, the user U hears the sound N from the sound source S of the external environment in a manner substantially equivalent to the case in which the head mounted acoustic device 51 is not worn.

Figure 4:
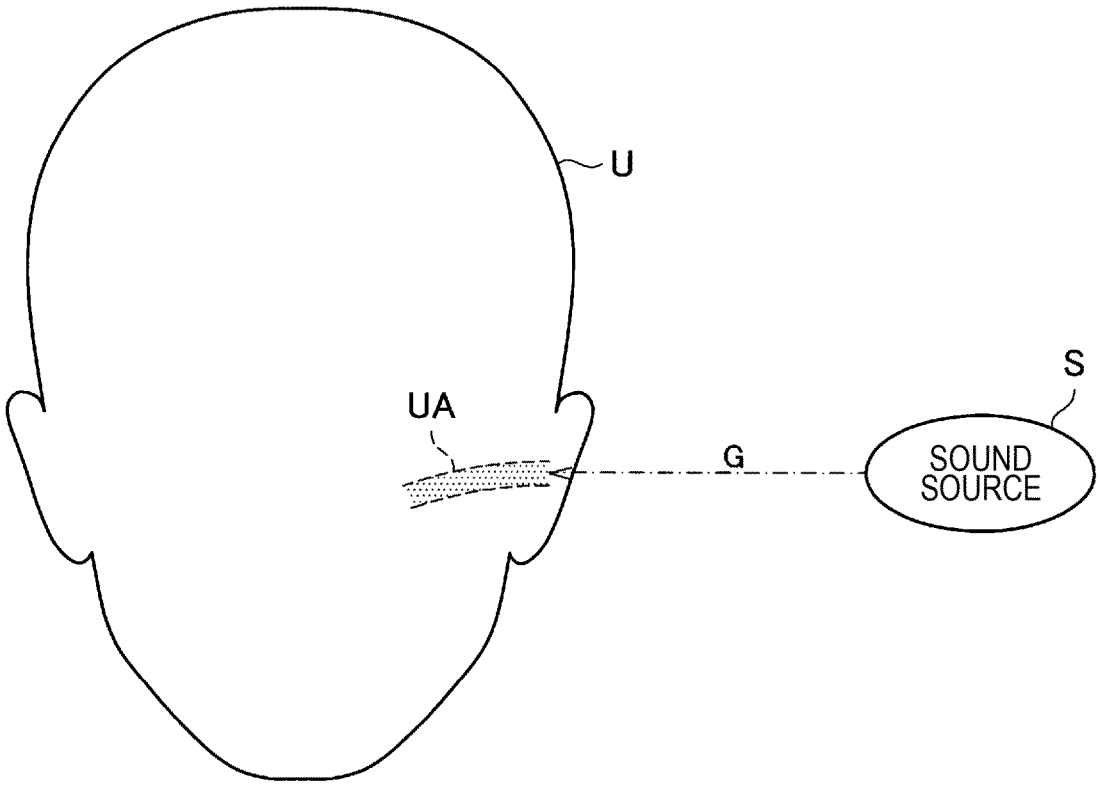
FIG. 4 is a diagram schematically illustrating an example of a propagation environment before an ambient sound is heard by the user in a case in which the user does not wear a head mounted acoustic device.

For example, FIG. 4 sis a diagram schematically illustrating an example of the propagation environment before the sound N from the sound source S is heard by the user U in a case in which the user U does not wear the head mounted acoustic device 51. In FIG. 4, reference numeral G schematically indicates a transfer function of a propagation environment before the sound N from the sound source S directly reaches the inside of the external ear canal UA of the user U.

In other words, in a case in which the hear-through effect is implemented on the basis of the head mounted acoustic device 51 illustrated in FIG. 2, it is preferable to generate the sound to be output from the speaker 74 so that the situation illustrated in FIG. 3 (the situation in which the head mounted acoustic device 51 is worn) and the situation illustrated in FIG. 4 (the situation in which the head mounted acoustic device 51 is not worn) are equalized.

Specifically, if the filter coefficient of the filter circuit 72 in the case of implementing the hear-through effect is indicated by γ, it is possible to implement the hear-through effect ideally by designing the filter coefficient γ so that relational expressions indicated by (Formula 2) and (Formula 3) below are satisfied.

[Math. 2]

$$F'AHM\gamma N + FN \approx GN \quad \text{(Formula 2)}$$

$$\gamma \approx \frac{(G-F)}{(F'AHM)} \quad \text{(Formula 3)}$$

Further, each of the noise canceling and the hear-through effect is implemented by adding a sound wave of the sound N propagated to the inside of the external ear canal UA via the head mounted acoustic device 51 and a sound wave of the sound N output from the speaker 74 in the air as illustrated in FIG. 2. Therefore, it is understood that it is preferable that a delay amount before the sound N from the sound source S is collected by the microphone 71 and output from the speaker 74 via the filter circuit 72 and the power amplifier 73, including a conversion process performed by an AD converter (ADC) or a DA converter (DAC), be suppressed to be about 100 μs or less.

Here, the reason for suppressing the delay amount to be 100 μs or less will be described in further detail. In the case of implementing the hear-through effect on the basis of a sound collection result of the microphone 71 installed in the housing in the head mounted acoustic device 51 having the high hermeticity (for example, a canal type earphone or an overhead type headphone), it is preferable to constitute the filter circuit 72 of the filter coefficient γ as a digital filter by installing the ADC and the DAC. This is because if the filter circuit 72 is constituted as a digital filter, it is possible to easily implement a filter process which is smaller in variation than in an analog filter and is unable to be implemented by an analog filter.

On the other hand, in the case in which the ADC and the DAC are installed, the processing load is increased by the filtering process such as decimation and interpolation, and a delay occurs accordingly.

As described above, in FIG. 2, the sound output from the speaker 74 and the sound N from the sound source S propagating via the propagation environment F in FIG. 2 are added in the space in the external ear canal UA (that is, a space near the eardrum), and an added sound is recognized by the user as one sound. Therefore, it is generally known that if the delay amount exceeds 10 ms, it is recognized as if an echo occurs, or it is recognized as if a sound is heard twice. Even in a case in which the delay amount is less than 10 ms, the frequency characteristic may be influenced by mutual interference of sounds or it may be difficult to implement the hear-through effect and the noise canceling.

As a concrete example, in FIG. 2, a delay of 1 ms is assumed to occurs between the sound output from the speaker 74 and the sound N from the sound source S propagating via the propagation environment F. In this case, an acoustic signal of a band near 1 kHz undergoes phase shift corresponding to one cycle (that is, 360°) and then added. On the other hand, an acoustic signal of ae band near 500 Hz has a reverse phase and then is cancelled. In other words, in a case in which signals with a delay of 1 ms are added simply, a so-called dip occurs. On the other hand, if the delay amount is suppressed to be 100 μs, it is possible to increase a frequency band at which the dip occurs due to a reverse phase relation up to 5 kHz.

Generally, the human external ear canal is known to have resonance points near about 3 kHz to 4 kHz although there are individual differences. For this reason, in the frequency band exceeding 4 kHz, it corresponds to the so-called individual difference part, and thus the appropriate hear-through effect is considered to be obtained by suppressing the delay amount to be 100 μs or less and adjusting the frequency band at which the dip occurs to be around 5 kHz.

[2.2. Basic Functional Configuration]

Figure 5:
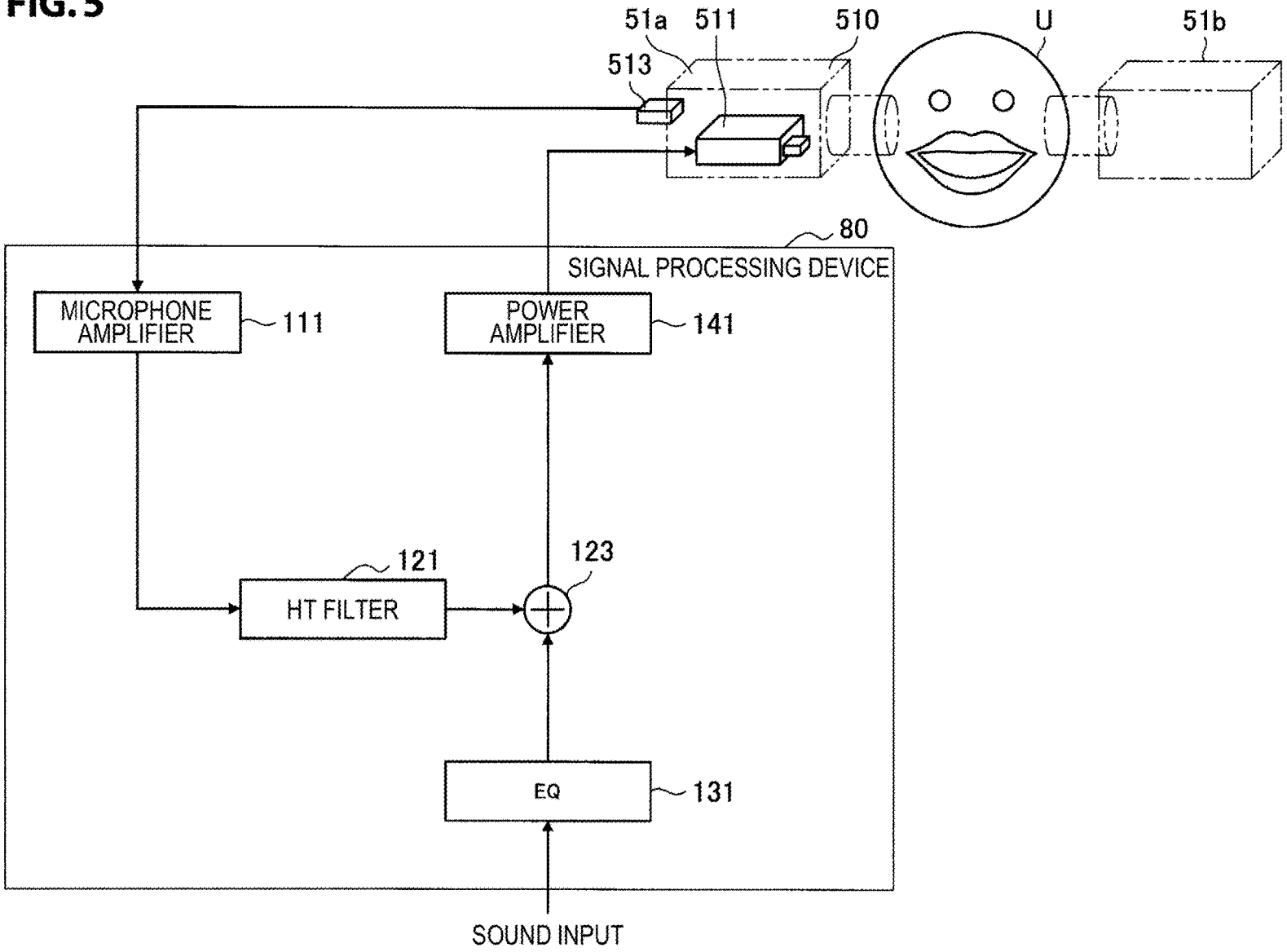
FIG. 5 is a block diagram illustrating an example of a basic functional configuration of a signal processing device according to an embodiment of the present disclosure.

Next, an example of the basic functional configuration of the signal processing device for implementing the hear-through effect will be described with reference to FIG. 5. FIG. 5 is a block diagram illustrating an example of a basic functional configuration of a signal processing device 80 according to an embodiment of the present disclosure. As described above, the signal processing device 80 practically includes a DAC and an ADC in order to convert each acoustic signal into a digital signal and perform various kinds of filter processes, but in the example illustrated in FIG. 5, in order to facilitate understanding of the description, description of the DAC and the ADC is omitted.

In FIG. 5, each of reference numerals 51*a* and 51*b* indicates the head mounted acoustic device 51. In other words, reference numeral 51*a* indicates the head mounted acoustic device 51 worn on the right ear, and reference numeral 51*b* indicates the head mounted acoustic device 51 attached to the left ear. In a case in which the head mounted acoustic devices 51*a* and 51*b* are not particularly distinguished, there are also referred to as a "head mounted acoustic device 51" as described above. In the example illustrated in FIG. 5, since the head mounted acoustic devices 51*a* and 51*b* have similar configurations, the illustration is focused on the head mounted acoustic device 51*a* side, and illustration of the head mounted acoustic device 51*b* is omitted.

As illustrated in FIG. 5, the head mounted acoustic device 51 includes a mounting unit 510, a driver 511, and an external microphone 513.

The mounting unit 510 illustrates a part worn on the user U in the housing of the head mounted acoustic device 51.

For example, in a case in which the head mounted acoustic device 51 is configured as a so-called canal type earphone, the mounting unit 510 has an outer shape in which that it is worn on the ear of the user U such that at least a part thereof is insertable into the ear hole of the user U who is the wearer. Specifically, in this case, an ear hole insertion portion having a shape insertable into the ear hole of the user U is formed in the mounting unit 510, and the mounting unit 510 is worn on the ears of the user U such that the ear hole insertion portion is inserted into the ear hole. For example, the example illustrated in FIG. 3 illustrates a state in which the mounting unit 510 of the head mounted acoustic device 51 is worn on the ear of the user U.

In a case in which the mounting unit 510 is worn on the user U, the space in the mounting unit 510 (that is, the space connected to the external ear canal UA of the user U) corresponds to the internal space.

The driver 511 is a component for driving an acoustic device such as the speaker and causing the acoustic device to output the sound based on the acoustic signal. As a specific example, the driver 511 causes the speaker to output the sound based on the acoustic signal by vibrating a vibration plate of the speaker on the basis of an input analog acoustic signal (that is, a drive signal).

The external microphone 513 is a sound collecting device that directly collects a sound (a so-called ambient sound) propagating via an external space outside the mounting unit 510 for enabling the head mounted acoustic device 51 to be worn on the user U. For example, the external microphone 513 may be configured as a so-called micro electro mechanical systems (MEMS) microphone which is formed on the basis of the MEMS technology. An installation position of the external microphone 513 is not particularly limited as long as it is able to collect the sound propagating via the external space. As a specific example, the external microphone 513 may be installed in the mounting unit of the head mounted acoustic device 51 or may be installed at a position different from the mounting unit. The sound (that is, the ambient sound) collected by the external microphone 513 corresponds to an example of a "first sound."

The signal processing device 80 illustrated in FIG. 5 is a component for executing various signal processing (for example, the filter process described above with reference to FIGS. 2 to 4) in order to implement the hear-through effect. As illustrated in FIG. 5, the signal processing device 80 includes a microphone amplifier 111, an HT filter 121, an adding unit 123, a power amplifier 141, and an equalizer (EQ) 131.

The microphone amplifier 111 is a so-called amplifier for adjusting a gain of the acoustic signal. The ambient sound collected by the external microphone 513 undergoes gain adjustment (for example, amplification) performed by the microphone amplifier 111 and is then input to the HT filter 121.

The HT filter 121 corresponds to the filter circuit 72 (see FIG. 2) in the case of implementing the hear-through effect described above with reference to FIGS. 2 to 4. In other words, the HT filter 121 performs signal processing based on the filter coefficient γ described on the basis of (Formula 2) and (Formula 3) on the acoustic signal output from the microphone amplifier 111 (that is, the acoustic signal which has been collected by the external microphone 513 and has undergone the gain adjustment performed by the microphone amplifier 111). At this time, the acoustic signal output as a result of performing signal processing by the HT filter 121 is hereinafter also referred to as a "difference signal." In other words, the ambient sound in a case in which the user directly hears it is simulated (that is, the hear-through effect is implemented) by adding the difference signal and the ambient sound propagating to the internal space via the mounting unit 510 of the head mounted acoustic device 51 (that is, the sound propagating via the propagation environment F in FIGS. 2 and 3). The HT filter 121 corresponds to an example of a "first filter processing unit."

The HT filter 121 outputs the difference signal generated as a result of performing signal processing on the acoustic signal output from the microphone amplifier 111 to the adding unit 123.

The EQ 131 performs a so-called equalizing process on the acoustic signal input to the signal processing device 80 (hereinafter also referred to as a "sound input") such as audio content or a received signal in a voice call. As a specific example, in a case of feeding back the sound collection result for the ambient sound as in the case of implementing the noise canceling and the hear-through effect, a gain of a low-frequency side component tends to increases due to a sound characteristic of the ambient sound. Therefore, the EQ 131 corrects the sound characteristic (for example, frequency characteristic) of the sound input so that the sound component on the low frequency side to be superimposed on the basis of the feedback is suppressed from the sound input in advance. The sound input corresponds to an example of an "input acoustic signal."

Then, the EQ 131 outputs the sound input which has undergone the equalizing process to the adding unit 123.

The adding unit 123 adds the difference signal output from the HT filter 121 to the sound input output from the EQ 131 (that is, the sound input that has undergone the equalizing process) and outputs the acoustic signal generated as the addition result to the power amplifier 141.

The power amplifier 141 is a so-called amplifier for adjusting the gain of the acoustic signal. The acoustic signal output from the adding unit 123 (that is, the addition result of the sound input and the difference signal) undergoes gain adjustment (that is, amplification) performed by the power amplifier 141 and is then output to the driver 511. Then, the driver 511 drives the speaker on the basis of the acoustic signal output from the power amplifier 141, and thus the sound based on the acoustic signal is radiated into the internal space inside the mounting unit 510 (that is, the space connected to the external ear canal UA of the user U).

The sound radiated into the internal space by the driver 511 driving the speaker is added to the ambient sound propagating to the internal space (that is, the sound propagating via the propagation environment F in FIGS. 2 and 3) via the mounting unit 510 of the head mounted acoustic device 51 and heard by the user U. At this time, the component of the difference signal included in the sound radiated from the driver 511 to the internal space is added to the ambient sound propagated to the internal space via the mounting unit 510 and heard by the user U. In other words, the user U is able to hear the ambient sound in a manner similar to that in the case in which the head mounted acoustic device 51 is not worn as illustrated in FIG. 4 in addition to the sound input such as the audio content.

It should be noted that the operation of the signal processing device 80 described above is merely an example, and the signal processing device 80 need not necessarily faithfully reproduce the hear-through effect if the user U is able to hear the ambient sound in a state in which the user U is wearing the head mounted acoustic device 51. As a specific example, the HT filter 121 may control a characteristic and a gain of the difference signal such that the user U feels the volume of the ambient sound higher than in the state in which the user U does not wear the head mounted acoustic device 51. Similarly, the HT filter 121 may control the characteristic and the gain of the difference signal so that the user U feels the volume of the ambient sound lower than in the state where the user U does not wear the head mounted acoustic device 51. On the basis of this configuration, for example, the signal processing device 80 may control the volume of the ambient sound heard by the user U in accordance with an input state of the sound input or a type of sound input (for example, audio content, a received signal of a voice call, or the like).

As described above, the example of the basic functional configuration of the signal processing device for implementing the hear-through effect has been described above with reference to FIG. 5.

Figure 6:
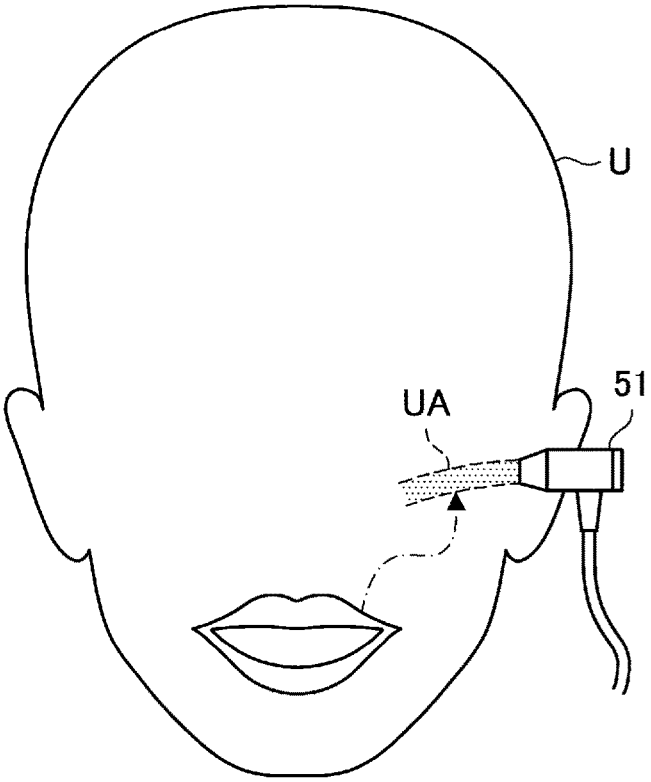
FIG. 6 is an explanatory diagram for describing a mechanism of the occurrence of a phenomenon in which vibration of a voice uttered by the user propagates within an internal space.

On the other hand, in a case in which the user U is wearing the head mounted acoustic device 51 having the high hermeticity such as a so-called canal type earphone, the user U may have a strange feeling with how a voice uttered by the user U is heard, and this point is similar in the example illustrated in FIG. 5. This is because that the vibration of the voice uttered by the user propagates within the internal space. In this regard, a mechanism in which the vibration of the voice uttered by the user propagates in the internal space will be described with reference to FIG. 6. FIG. 6 is an explanatory diagram for describing a mechanism in which the vibration of the voice uttered by the user propagates in the internal space.

As illustrated in FIG. 6, the vibration of the voice uttered by the user U propagates to the external ear canal UA via bones or flesh in the head of the user U, so that the external ear canal wall is vibrated like a secondary speaker. Here, in a case in which the head mounted acoustic device 51 having the high hermeticity such as a canal type earphone is worn, a degree of hermeticity of the space in the external ear canal UA is increased by the head mounted acoustic device 51, and an escape route in the air is limited, and thus the vibration in the space is directly transferred to the eardrum. At this time, the vibration of the voice uttered by the user U propagating in the internal space is transferred to the eardrum as if the low frequency is amplified, and thus the user U hears his/her voice as if it is muffled, and the user U has a strange feeling accordingly.

Signal processing devices according to embodiments of the present disclosure were made in view of the problem as described above, and it is desirable to implement to implement the hear-through effect in a more appropriate manner (that is, in a manner in which the user has a less strange feeling).

<3. First Embodiment>

Figure 7:
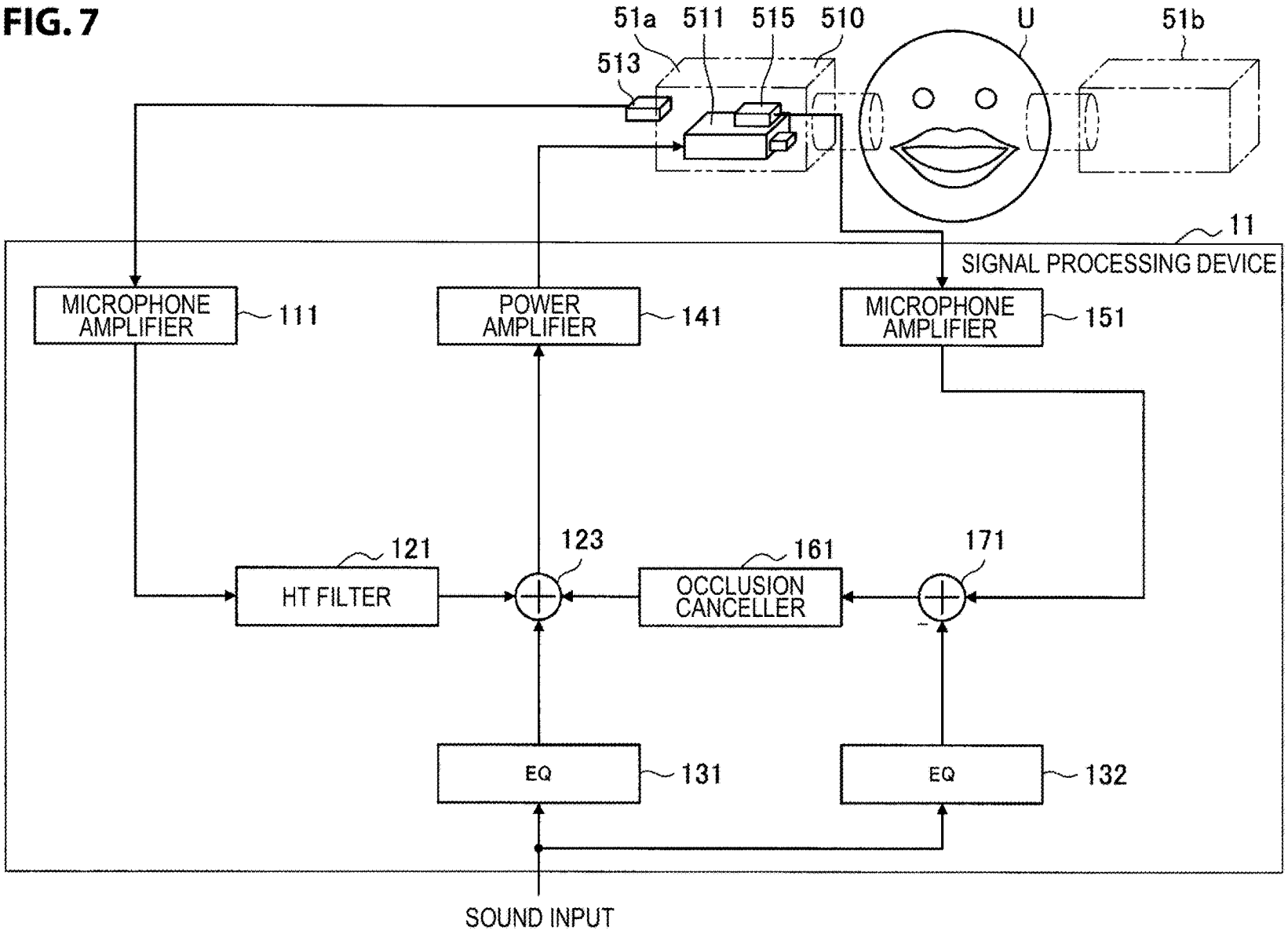
FIG. 7 is a block diagram illustrating an example of a functional configuration of a signal processing device according to a first embodiment of the present disclosure.

First, an example of a functional configuration of a signal processing device according to a first embodiment of the present disclosure will be described with reference to FIG. 7. FIG. 7 is a block diagram illustrating an example of a functional configuration of the signal processing device according to the present embodiment. In the following description, the signal processing device according to the present embodiment is also referred to as a "signal processing device 11" in order to be distinguished from the signal processing device 80 (see FIG. 5). Further, similarly to the example illustrated in FIG. 5, in order to facilitate understanding of description, illustration of the DAC and the ADC is omitted in the functional configuration illustrated in FIG. 7.

As illustrated in FIG. 7, the signal processing device 11 according to the present embodiment differs from the signal processing device 80 (see FIG. 5) in that a microphone amplifier 151, a subtracting unit 171, an occlusion canceller 161, and an EQ 132 are provided. As illustrated in FIG. 7, the head mounted acoustic device 51 to which the signal processing device 11 according to the present embodiment is applicable differs from the head mounted acoustic device 51 to which the signal processing device 80 is applicable (see FIG. 5) in that an internal microphone 515 is provided. In this regard, in the following description, the functional configurations of the signal processing device 11 according to the present embodiment and the head mounted acoustic device 51 to which the signal processing device 11 is applicable will be described particularly focusing on a difference with those in the example illustrated in FIG. 5.

The internal microphone 515 is a sound collecting device that collects the sound propagating to the internal space inside the mounting unit 510 that enables the head mounted acoustic device 51 to be worn on the user U (that is, the space connected to the external ear canal UA of the user U). Similarly the external microphone 513, the internal microphone 515 may be configured as, for example, a so-called MEMS microphone formed on the basis of MEMS technology.

For example, the internal microphone 515 is installed in the mounting unit 510 to face the direction of the external ear canal UA. It will be appreciated that an installation position is not particularly limited as long as the internal microphone 515 is capable of collecting the sound propagating to the internal space.

The acoustic signal collected by the internal microphone 515 includes a component of the sound output from the speaker on the basis of control performed by the driver 511, a component of the ambient sound propagating to the internal space via the mounting unit 510 (the sound propagating via the propagation environment F in FIGS. 2 and 3), and a component of a voice of the user propagating to the external ear canal UA (the component of the voice illustrated in FIG. 6). Further, the sound collected by the internal microphone 515 (that is, the sound propagating to the internal space) corresponds to an example of a "second sound."

The microphone amplifier 151 is a so-called amplifier that adjusts the gain of the acoustic signal. The acoustic signal based on the sound collection result obtained by the internal microphone 515 (that is, the sound collection result for the sound propagating to the internal space) undergoes gain adjustment (for example, amplification) performed by the microphone amplifier 151 and is then input to the subtracting unit 171.

The EQ 132 is a component for performing the equalizing process on the sound input in accordance with the device characteristics of the internal microphone 515 and the microphone amplifier 151. Specifically, in a case in which the transfer function based on the device characteristics of the internal microphone 515 and the microphone amplifier 151 is indicated by M, the EQ 132 applies a frequency characteristic which is "target characteristic—M" to the sound input. The transfer function M corresponding to the device characteristics of the internal microphone 515 and the microphone amplifier 151 may be calculated in advance on the basis of a result of a prior experiment or the like. Then, the EQ 132 outputs the sound input which has undergone the equalizing process to the subtracting unit 171. The sound input which has undergone the equalizing process performed by EQ 132 corresponds to an example of a "second signal component."

The subtracting unit 171 subtracts the sound input output from the EQ 132 (that is, the sound input to which the frequency characteristic which is "target characteristic—M" is applied) from the acoustic signal output from the microphone amplifier 151, and outputs the acoustic signal generated as a subtraction result to the occlusion canceller 161. The acoustic signal output as the subtraction result obtained by the subtracting unit 171 corresponds to the acoustic signal in which the component of the sound input among the components of the acoustic signal collected by the internal microphone 515 is suppressed. More specifically, the acoustic signal includes a component in which the difference signal and the ambient sound propagating to the internal space via the mounting unit 510 are added (hereinafter also referred to as an "ambient sound component") and the component of the voice of the user U propagating to the external ear canal UA via bones or flesh of the head of the user U (hereinafter also referred to simply as a "voice component").

The occlusion canceller 161 corresponds to a so-called filter processing unit operating on a principle similar to that of so-called feed-back (FB) type NC filter. The occlusion canceller 161 generates an acoustic signal for suppressing the component of the acoustic signal to a predetermined volume (hereinafter also referred to as a "noise reduction signal") on the acoustic signal output from the subtracting unit 171.

As described above, the acoustic signal output from the subtracting unit 171 includes the ambient sound component and the voice component, and the low frequency side of the voice component is amplified due to a property of a propagation path. Therefore, for example, in order to enable the user U to hear the voice component in a manner similar to that in the case in which the user U does not wear the head mounted acoustic device 51, the occlusion canceller 161 may generate the noise reduction signal for suppressing the low frequency side of the voice component among the voice components of the acoustic signal acquired from the subtracting unit 171. Further, the occlusion canceller 161 corresponds to an example of a "second signal processing unit."

As described above, the occlusion canceller 161 generates the noise reduction signal on the basis of the acoustic signal output from the subtracting unit 171. Then, the occlusion canceller 161 outputs the generated noise reduction signal to the adding unit 123.

The EQ 131 performs the equalizing process on the sound input, similarly to the EQ 131 described above with reference to FIG. 5.

The EQ 131 according to the present embodiment further performs the equalizing process on the sound input in accordance with to a characteristic to be applied to the output sound depending on a structure or the like of the speaker driven by the driver 511 and the transfer function of the space from the speaker to the internal microphone 515. For example, a function obtained by multiplying the transfer function corresponding to the characteristic applies to the output sound depending on the structure or the like of the speaker driven by the driver 511 by the transfer function of the space from the speaker to the internal microphone 515 is indicated by H. In this case, the EQ 131 applies a frequency characteristic which is "target characteristic 1/H to the sound input. Further, it is preferable to calculate the transfer function corresponding to the characteristic to be applied to the output sound depending on the structure or the like of the speaker driven by the driver 511 and the transfer function of the space from the speaker to the internal microphone 515 in advance on the basis of a result of an experiment or the like. Then, the EQ 131 outputs the sound input which has undergone the equalizing process to the adding unit 123.

The adding unit 123 adds the difference signal output from the HT filter 121 and the noise reduction signal output from the occlusion canceller 161 to the sound input output from the EQ 131 (that is, the sound input after the equalizing process). Then, the adding unit 123 outputs the acoustic signal generated as an addition result to the power amplifier 141.

The acoustic signal output from the adding unit 123 (that is, the addition result of the sound input, the difference signal, and the noise reduction signal) undergoes gain adjustment (for example, amplification) performed by the power amplifier 141 and is then output to the driver 511. Then, the driver 511 drives the speaker on the basis of the acoustic signal output from the power amplifier 141, and thus the sound based on the acoustic signal is radiated into the internal space in the mounting unit 510 (that is, the space connected with the external ear canal UA of the user U Space).

The example of the functional configuration of the signal processing device 11 according to the present embodiment has been described above with reference to FIG. 7. The configuration of the signal processing device 11 is not necessarily limited to the example illustrated in FIG. 7 as long as the operations of the components of the signal processing device 11 described above can be implemented.

Figure 8:
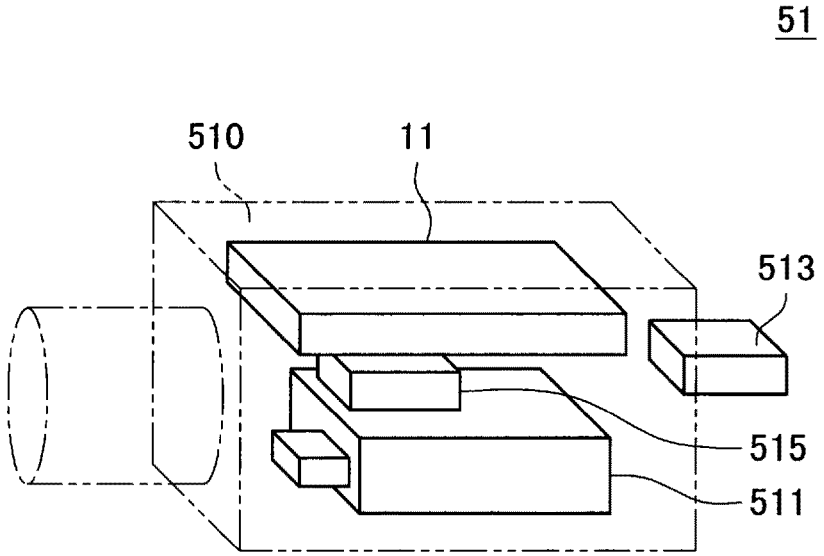
FIG. 8 is an explanatory diagram for describing an example of a configuration of the signal processing device according to the embodiment.

For example, FIG. 8 is an explanatory diagram for describing an example of the configuration of the signal processing device 11 according to the present embodiment. In the example illustrated in FIG. 7, the head mounted acoustic device 51 and the signal processing device 11 are configured as different devices. On the other hand, FIG. 8 illustrates an example of a configuration in a case in which the head mounted acoustic device 51 and the signal processing device 11 are installed in the same housing. Specifically, in the example illustrated in FIG. 8, a configuration (for example, a signal processing unit) corresponding to the signal processing device 11 is installed in the mounting unit 510 of the head mounted acoustic device 51.

It will be appreciated that the signal processing device 11 may be configured as an independent device or may be configured as a part of an information processing device such as a so-called smartphone or the like. Further, at least some components of the signal processing device 11 may be installed in an external device (for example, a server or the like) different from the signal processing device 11. In this case, it is preferable that a delay amount before the ambient sound propagating via the external environment is collected by the external microphone 513 and output from the speaker of the head mounted acoustic device 51 via the HT filter 121 and the power amplifier 141, including the conversion process performed by the ADC and the DAC, be suppressed to be about 100 μs or less.

As described above, the signal processing device 11 according to the present embodiment generates the noise reduction signal for suppressing at least some components among the voice components of the user U on the basis of the sound collection result obtained by the internal microphone 515 (that is, the sound collection result for the sound propagating to the internal space). Then, the signal processing device 11 adds the generated difference signal and the noise reduction signal to the input sound input, and outputs the added acoustic signal. Accordingly, the driver 511 of the head mounted acoustic device 51 drives the speaker on the basis of the acoustic signal output from the signal processing device 11, and thus the sound based on the acoustic signal is radiated into the internal space.

The sound radiated into the internal space when the driver 511 drives the speaker includes a component based on the noise reduction signal generated by the occlusion canceller 161. The component on the basis of the noise reduction signal is added to the voice component of the user U propagating to the external ear canal UA in the internal space on the basis of an utterance of the user U. Accordingly, at least some components among the voice components (for example, the component on the lower frequency side among the voice components) is suppressed, and the suppressed voice component reaches the eardrum of the user U and is heard by the user U. In other words, according to the signal processing device 11 of the present embodiment, it is possible to implement the hear-through effect in a manner in which the user U has no strange feeling in his/her voice being heard.

<4. Second Embodiment>

Next, a signal processing device according to a second embodiment of the present disclosure will be described. In the first embodiment, the hear-through effect is implemented in a manner in which the user U has no strange feeling in his/her voice being heard by providing the occlusion canceller 161. On the other hand, in the signal processing device 11 according to the first embodiment, the acoustic signal to be processed by the occlusion canceller 161 includes the component of the difference signal output from the speaker of the head mounted acoustic device 51. For this reason, there are cases in which the hear-through effect is not sufficiently obtained (or an ambient sound having a different characteristic is heard by the user U) since the component of the difference signal is suppressed by the noise reduction signal which is generated by the occlusion canceller 161 on the basis of the acoustic signal.

In other words, the signal processing device according to the present embodiment was made in view of the problem described above, and it is desirable to implement the hear-through effect in a more natural manner (that is, in a manner in which the user has a less strange feeling) than the signal processing device 11 according to the first embodiment. In the following description, the signal processing device according to the present embodiment is also referred to as a "signal processing device 12" in order to be distinguished from the signal processing device 11 according to the first embodiment.

[4.1. Schematic Functional Configuration]

Figure 9:
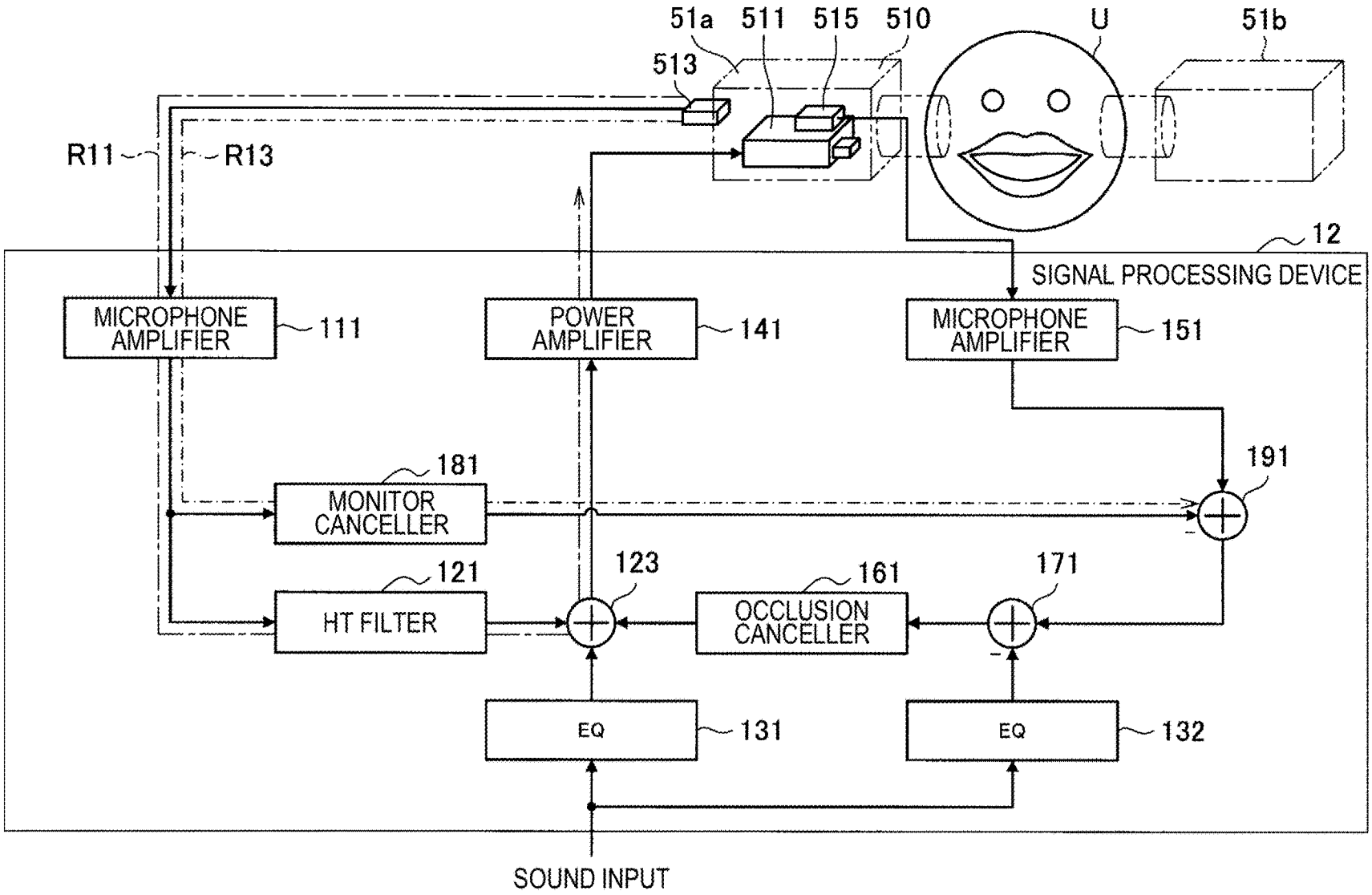
FIG. 9 is a block diagram illustrating an example of a functional configuration of a signal processing device according to a second embodiment of the present disclosure.

First, an example of a functional configuration of a signal processing device 12 according to the present embodiment will be described with reference to FIG. 9. FIG. 9 is a block diagram illustrating an example of a functional configuration of a signal processing device according to the present embodiment. Further, similarly to the examples illustrated in FIGS. 5 and 7, in order to facilitate understanding of description, illustration of the DAC and the ADC is omitted in the functional configuration illustrated in FIG. 9.

As illustrated in FIG. 9, the signal processing device 12 according to the present embodiment differs from the signal processing device 11 according to the first embodiment (see FIG. 7) in that a monitor canceller 181 and a subtracting unit 191 are provided. Therefore, in the following description, the functional configuration of the signal processing device 12 according to the present embodiment will be described focusing on a difference with the signal processing device 11 according to the first embodiment described above (see FIG. 7).

The monitor canceller 181 and the subtracting unit 191 are configured to suppress a component corresponding to the difference signal among components in the acoustic signal output from the microphone amplifier 151 (that is, the acoustic signal on the basis of the sound collection result of the internal microphone 515).

In the signal processing device 12 illustrated in FIG. 9, the ambient sound collected by the external microphone 513 undergoes gain adjustment (for example, amplification) performed by the microphone amplifier 111 and is then input to the HT filter 121 and the monitor canceller 181.

Similarly to the HT filter 121, the monitor canceller 181 performs the signal processing based on the filter coefficient $\gamma$ described on the basis of (Formula 2) and (Formula 3) on the acoustic signal output from the microphone amplifier 111, and generates the difference signal.

Further, the monitor canceller 181 performs a filter process on the generated difference signal on the basis of the transfer function corresponding to each characteristic so that influences of the device characteristic of each of the power amplifier 141, the driver 511, and the microphone amplifier 151 and a spatial characteristic in the internal space are reflected. This is because a characteristic of a route from the occlusion canceller 161 to the occlusion canceller 161 via the power amplifier 141, the driver 511, and the microphone amplifier 151 is not reflected in the acoustic signal output from the microphone amplifier 111.

In the monitor canceller 181, an infinite impulse response filter (an IIR filter) and a finite impulse response filter (a FIR filter) may be installed as a configuration for executing the filter process. In this case, for example, in the filter processes described above, a simple process for a delay component may be mainly allocated to the FIR filter, and a process related to frequency characteristic may be mainly allocated to the IIR filter.

It will be appreciated that the configuration in which the IIR filter and the FIR filter are installed is merely an example, and the configuration of the monitor canceller 181 is not necessarily limited. As a specific example, the FIR filter may be installed in the monitor canceller 181, and both of the simple process for the delay component and the process related to the frequency characteristic may be executed by the FIR filter.

As another example, in a case in which the influence of the delay component is sufficiently small, the filter process may be implemented only by the IIR filter. As an example of a method for reducing the influence of the delay component, for example, a method of employing the ADC and the DAC or employing a low-delay device as a filter (for example, a decimation filter) used for bit rate conversion may be used. Further, a device having a smaller driving delay (that is, a more responsive device) may be employed as a sound system such as the driver 511 (and the speaker), the external microphone 513, or the internal microphone 515. Further, a sound speed delay between the speaker and the internal microphone 515 may be reduced by bringing the speaker driven by the driver 511 and the internal microphone 515 closer to each other in the internal space.

The device characteristic of each of the power amplifier 141, the driver 511, and the microphone amplifier 151 and the spatial characteristic in the internal space may be derived in advance using, for example, a time stretched pulse (TSP) or the like. In this case, for example, each characteristic may be calculated on the basis of measurement results of the acoustic signal (TSP) input from the power amplifier 141 (specifically, the DAC) and the acoustic signal output from the microphone amplifier 151. As another example, the device characteristics of each of the power amplifier 141, the driver 511, and the microphone amplifier 151 and the spatial characteristic in the internal space may be individually measured, and the respective measurement results may be convoluted. In other words, the filter characteristic of the monitor canceller 181 may be adjusted in advance on the basis of the prior measurement result of each characteristic described above. The monitor canceller 181 corresponds to an example of a "third filter processing unit." Further, the acoustic signal which has undergone the filter process performed by the monitor canceller 181 corresponds to a "first signal component."

Then, the monitor canceller 181 outputs the difference signal which has undergone various kinds of filter processes to the subtracting unit 191.

The subtracting unit 191 subtracts the difference signal output from the monitor canceller 181 from the acoustic signal output from the microphone amplifier 151, and outputs the acoustic signal generated as a subtraction result to the subtracting unit 171 positioned at a subsequent stage. At this time, the acoustic signal output as the subtraction result obtained by the subtracting unit 171 corresponds to an acoustic signal in which the component corresponding to the difference signal among the components of the acoustic signal collected by the internal microphone 515 is suppressed.

A subsequent process is similar to that of the signal processing device 11 according to the first embodiment. In other words, the component of the sound input output from the EQ 132 is subtracted from the acoustic signal output from the subtracting unit 191 through the subtracting unit 171, and the resulting acoustic signal is then input to the occlusion canceller 161. At this time, the acoustic signal input to the occlusion canceller 161 is an acoustic signal in which the component corresponding to a difference signal and the component corresponding to the sound input among the components of the acoustic signal collected by the internal microphone 515 are suppressed (that is, the voice component).

With this configuration, in the signal processing device 12 according to the present embodiment, it is possible to exclude the component of the difference signal from a processing target from which the occlusion canceller 161 generates the noise reduction signal. In other words, in the signal processing device 12 according to the present embodiment, it is possible to prevent the component of the difference signal from being suppressed by the noise reduction signal. Therefore, the signal processing device 12 according to the present embodiment is able to implement the hear-through effect in a more natural manner (that is, a manner in which the user U has a less strange feeling) than in the signal processing device 11 according to the first embodiment.

The example of the functional configuration of the signal processing device 12 according to the present embodiment has been described above with reference to FIG. 9.

[4.2. Configuration Example for Reducing Delay Amount]

Next, an example of a mechanism of reducing the delay amount before the signal processing device 12 according to the present embodiment adds the difference signal based on the sound collection result obtained by external microphone 513 and the noise reduction signal based on the sound collection result obtained by the internal microphone 515 to the sound input and outputs the resulting signal through the speaker will be described.

First, in FIG. 9, a route indicated by reference numeral R11, that is, a route on which the acoustic signal based on the sound collection result of the external microphone 513 is radiated into the internal space via the microphone amplifier 111, the HT filter 121, the power amplifier 141, and the driver 511 is focus on. As described above, in the route R11, in order to implement the hear-through effect in a preferable manner (specifically, in order to adjust the frequency band at which the dip occurs to be around 5 kHz), it is preferable to suppress the delay amount to be 100 μs or less. In the following description, the delay amount of the route R11 is also referred to as a "delay amount D_HTF."

Next, a route indicated by reference numeral R13, that is, a route on which the acoustic signal based on the sound collection result of the external microphone 513 reaches the subtracting unit 191 via the monitor canceller 181 is focused on. In the configuration illustrated in FIG. 9, the monitor canceller 181 generates the difference signal, similarly to the HT filter 121.

Further, a propagation delay will occur (propagates between the speaker and the internal microphone 515) before the driver 511 drives the speaker on the basis of the difference signal, and so the acoustic signal based on the sound including the component of the difference signal radiated into the internal space propagates in the space inside the internal space and is collected by the internal microphone 515. In the following description, a delay amount of the propagation delay in the internal space is also referred to as a "delay amount D_ACO."

In other words, in order to appropriately subtract the component of the difference signal from the acoustic signal collected by the internal microphone 515 in the subtracting unit 191, it is necessary to cause the delay amount of the route R13 to be equal to or less than a value obtained by adding the delay amount D_HTF (100 μs) and the delay amount D_ACO.

A distance between the speaker driven by the driver 511 and the internal microphone 515 is about 3 to 4 cm even in a case of a relatively long headphone such as a so-called overhead type headphone.

Here, if the distance between the speaker driven by the driver 511 and the internal microphone 515 is 3.4 cm, the delay amount D_ACO of the propagation delay in the internal space is 100 μs (=(0.034 m)/(sound speed=340 m/s). It will be appreciated that as the closer the distance between the speaker driven by the driver 511 and the internal microphone 515 is, the smaller the delay amount D_ACO is.

In this regard, in a case in which the delay amount of the route R13 is set to D_HTC, it is necessary to satisfy a relation of the delay amount D_HTC≤D_HTF+D_ACO and satisfy a relation of D_HTF≤100 μs and D_ACO≤100 μs.

Figure 10:
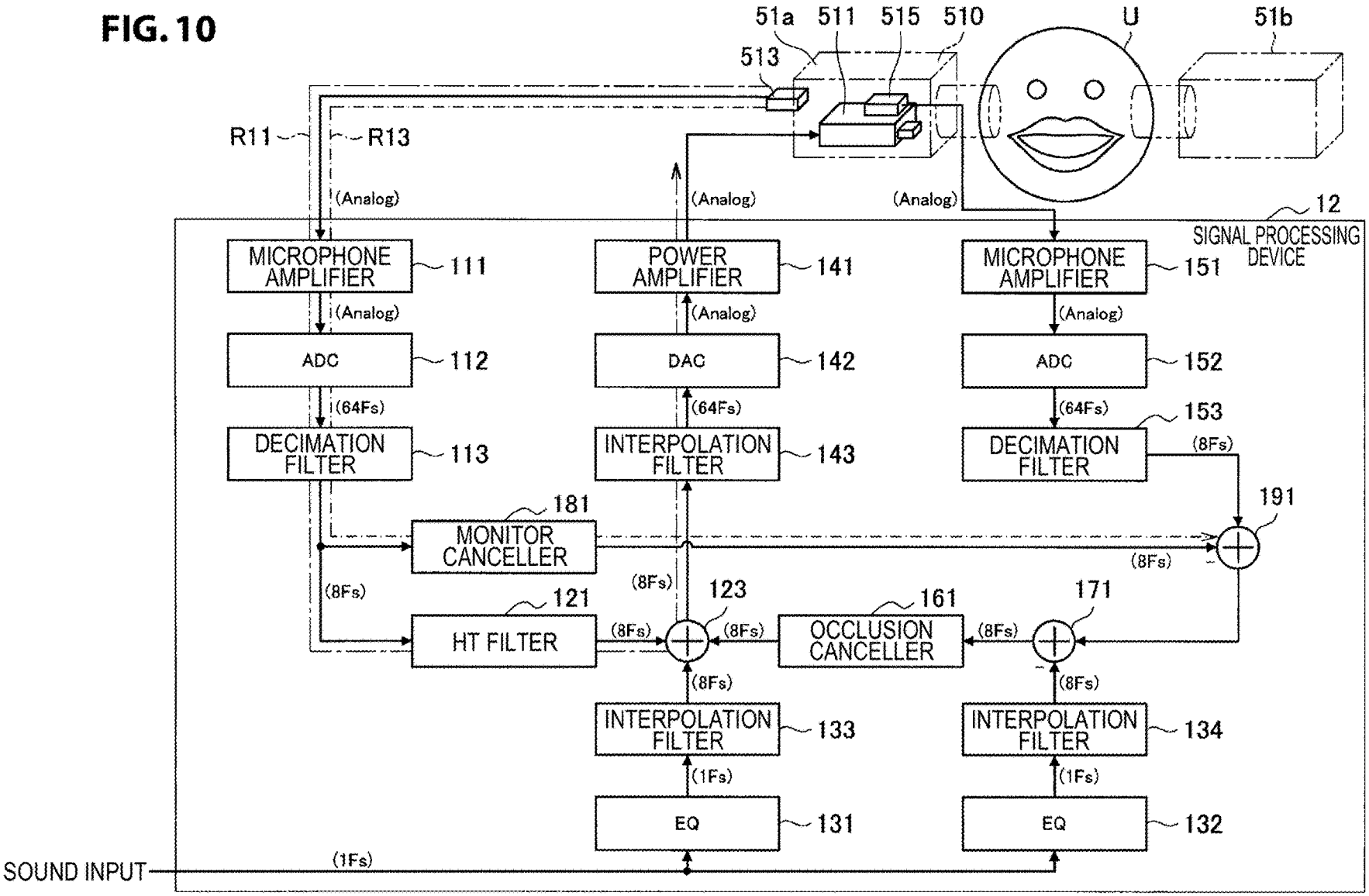
FIG. 10 is an explanatory diagram for describing an example of a configuration for further reducing a delay amount in the signal processing device according to the embodiment.

In this regard, an example of a configuration of a signal processing device 12 that satisfies the delay condition described above will be described with reference to FIG. 10. FIG. 10 is an explanatory diagram for describing an example of a configuration for further reducing the delay amount in the signal processing device 12 according to the present embodiment (that is, satisfying the delay condition described above). In the example illustrated in FIG. 10, an ADC and a DAC that perform a conversion process between an analog signal and a digital signal and a filter that converts a sampling rate of a digital signal are explicitly illustrated for the signal processing device 12 illustrated in FIG. 9.

Specifically, FIG. 10 explicitly illustrates ADCs 112 and 152, a DAC 142, decimation filters 113 and 153, and interpolation filters 133, 134, and 143 for the functional configuration of the signal processing device 12 illustrated in FIG. 9. In the example illustrated in FIG. 10, the sampling rate of the sound input input to the signal processing device 12 is assumed to be 1 Fs (1 Fs=48 kHz).

The ADCs 112 and 152 are components for converting an analog acoustic signal into a digital signal. For example, the ADCs 112 and 152 perform conversion into a digital signal by performing delta-sigma modulation on the analog acoustic signal. Further, the DAC 142 is a component for converting a digital signal into an analog acoustic signal.

The decimation filters 113 and 153 are components for down-sampling a sampling rate of an input digital signal to a predetermined sampling rate lower than the sampling rate. The interpolation filters 133, 134, and 143 are components for up-sampling the sampling rate of the input digital signal to a predetermined sampling rate higher than the sampling rate.

The analog acoustic signal output on the basis of the sound collection result of the external microphone 513 undergoes gain adjustment performed by the microphone amplifier 111 and then converted into a digital signal through the ADC 112. In the example illustrated in FIG. 10, the ADC 112 performs sampling on the input analog signal at the sampling rate of 64 Fs to be converted into a digital signal. The ADC 112 outputs the converted digital signal to the decimation filter 113.

The decimation filter 113 down-samples the sampling rate of the digital signal output from the ADC 112 from 64 Fs to 8 Fs. In other words, the components positioned at a stage subsequent to the decimation filter 113 (for example, the HT filter 121 and the monitor canceller 181) perform various kinds of processes on the digital signal whose sampling rate is down-sampled to 8 Fs.

Further, the analog acoustic signal output on the basis of the sound collection result of the internal microphone 515 undergoes gain adjustment performed by the microphone amplifier 151 and converted into a digital signal through the ADC 152. In the example illustrated in FIG. 10, the ADC 152 performs sampling on the input analog signal at the sampling rate of 64 Fs to be converted into a digital signal. The ADC 152 outputs the converted digital signal to the decimation filter 153.

The decimation filter 153 down-samples the sampling rate of the digital signal output from the ADC 152 from 64 Fs to 8 Fs. In other words, the component positioned at a stage subsequent to the decimation filter 153 (for example, the occlusion canceller 161) perform various kinds of processes on the digital signal whose sampling rate is down-sampled to 8 Fs.

The sound input (the digital signal of 1 Fs) which has undergone the equalizing process performed by the EQ 132 is up-sampled to the sampling rate of 8 Fs by the interpolation filter 134 and then input to the subtracting unit 171. Similarly, the sound input (the digital signal of 1 Fs) which has undergone the equalizing process performed by the EQ 131 is up-sampled to the sampling rate of 8 Fs by the interpolation filter 133 and then input to the adding unit 123.

Then, the addition unit 123 adds the difference signal output from the HT filter 121, the sound input output from the interpolation filter 133, and the noise reduction signal output from the occlusion canceller 161. At this time, all of the difference signal, the sound input, and the noise reduction signal added by the adding unit 123 are digital signals of 8 Fs.

Then, the digital signal of 8 Fs output as the addition result of the adding unit 123 is up-sampled to a digital signal of 64 Fs by the interpolation filter 143, converted into an analog acoustic signal by the DAC 142, and input to the power amplifier 141. Then, the analog acoustic signal undergoes gain adjustment performed by the power amplifier 141 and then input to the driver 511. Accordingly, when the driver 511 drives the speaker on the basis of the inputted analog acoustic signal, the speaker radiates the sound based on the analog acoustic signal into the internal space.

As described above, in the example illustrated in FIG. 10, the signal processing device 12 down-samples the digital signal of 64 Fs obtained by converting the collected analogue acoustic signal to about 8 Fs higher than the sampling rate (1 Fs) of the sound input.

In other words, in the signal processing device 12 illustrated in FIG. 10, the HT filter 121, the monitor canceller 181, and the occlusion canceller 161 execute each calculation (that is, the filter process) on the digital signal of 8 Fs, and thus it is possible to reduce a delay of one sampling unit.

Further, in the signal processing device 12 illustrated in FIG. 10, since the digital signal of 64 Fs is down-sampled to the digital signal of 8 Fs, it is possible to suppress the delay amount of the processes related to the down-sampling (that is, the processes of the ADC 112 and the ADC 152) to be smaller than in the case of down-sampling to the digital signal of 1 Fs. This similarly applies to the processes related to the up-sampling. In other words, in the signal processing device 12 illustrated in FIG. 10, since the digital signal of 8 Fs is up-sampled to the digital signal of 64 Fs, it is possible to suppress the delay amount of the processes related to the up-sampling (that is, the process of the DAC 142) to be smaller than in the case of up-sampling from the digital signal of 1 Fs.

Further, down-sampling to the digital signal of the lower sampling rate (for example, 1 Fs) may be further performed, and then the digital signal may be a processing target of at least some calculations of the HT filter 121, the monitor canceller 181, and the occlusion canceller 161.

Figure 11:
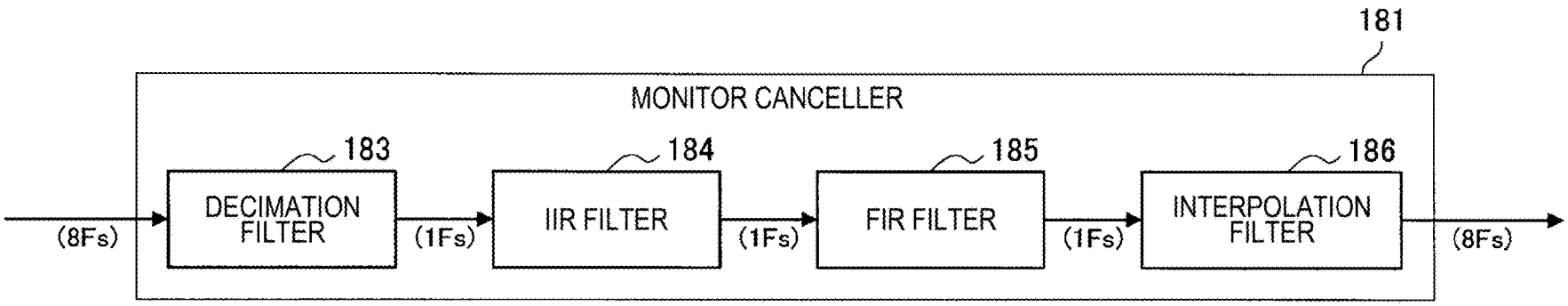
FIG. 11 is a diagram illustrating an example of a functional configuration of a monitor canceller.

For example, FIG. 11 is a diagram illustrating an example of a functional configuration of the monitor canceller 181. The monitor canceller 181 illustrated in FIG. 11 is configured so that various kinds of filter processes are executed on the digital signal of 1 Fs after the digital signal of 8 Fs is down-sampled to the digital signal of 1 Fs.

More specifically, the monitor canceller 181 illustrated in FIG. 11 includes a decimation filter 183, an IIR filter 184, an FIR filter 185, and an interpolation filter 186.

The decimation filter 183 down-samples the digital signal of 8 Fs input to the monitor canceller 181 into a digital signal of 1 Fs and outputs the digital signal down-sampled to 1 Fs to the IIR filter 184 positioned at a subsequent stage.

The IIR filter 184 and the FIR filter 185 are components for executing the filter process performed by the monitor canceller 181 described above with reference to FIG. 9. As described above, among the filter processes performed by the monitor canceller 181, the process related to the frequency characteristic is mainly allocated to the IIR filter 184, and the simple process for the delay component is allocated to the FIR filter 185. In the example illustrated in FIG. 11, the IIR filter 184 and the FIR filter 185 execute various kinds of filter processes on the digital signal of 1 Fs.

The digital signal (that is, the digital signal of 1 Fs) which has undergone various kinds of filter processes performed by the IIR filter 184 and the FIR filter 185 is up-sampled to the digital signal of 8 Fs through the interpolation filter 186. Then, the digital signal up-sampled to 8 Fs is output to the subtracting unit 191 (see FIG. 10) positioned at a stage subsequent to the monitor canceller 181.

As described above, in the signal processing device 12 according to the present embodiment, resources for the calculations may be reduced by reducing the sampling rate locally for at least some calculations among various kinds of calculations (for example, the calculations in the HT filter 121, the monitor canceller 181, and the occlusion canceller 161). A calculation in which the sampling rate is locally reduced among various kinds of calculations in the signal processing device 12 may be appropriately decided on the basis of a checking result of checking efficiency of resource reduction associated with the down-sampling through a prior experiment or the like.

The example of the mechanism for reducing the delay amount of each route (for example, the routes R11 and R13 illustrated in FIGS. 9 and 10) in the signal processing device 12 according to the present embodiment and implementing the hear-through effect in a more appropriate manner has been described above with reference to FIGS. 9 and 10. The example of the mechanism for reducing the delay amount through the signal processing device 12 illustrated in FIG. 9 has been described above, but it will be appreciated that it is possible to reduce the delay amount on the basis of a similar mechanism even in the signal processing device 80 illustrated in FIG. 5 or the signal processing device 11 illustrated in FIG. 7.

[4.3. Modified Example]

Figure 12:
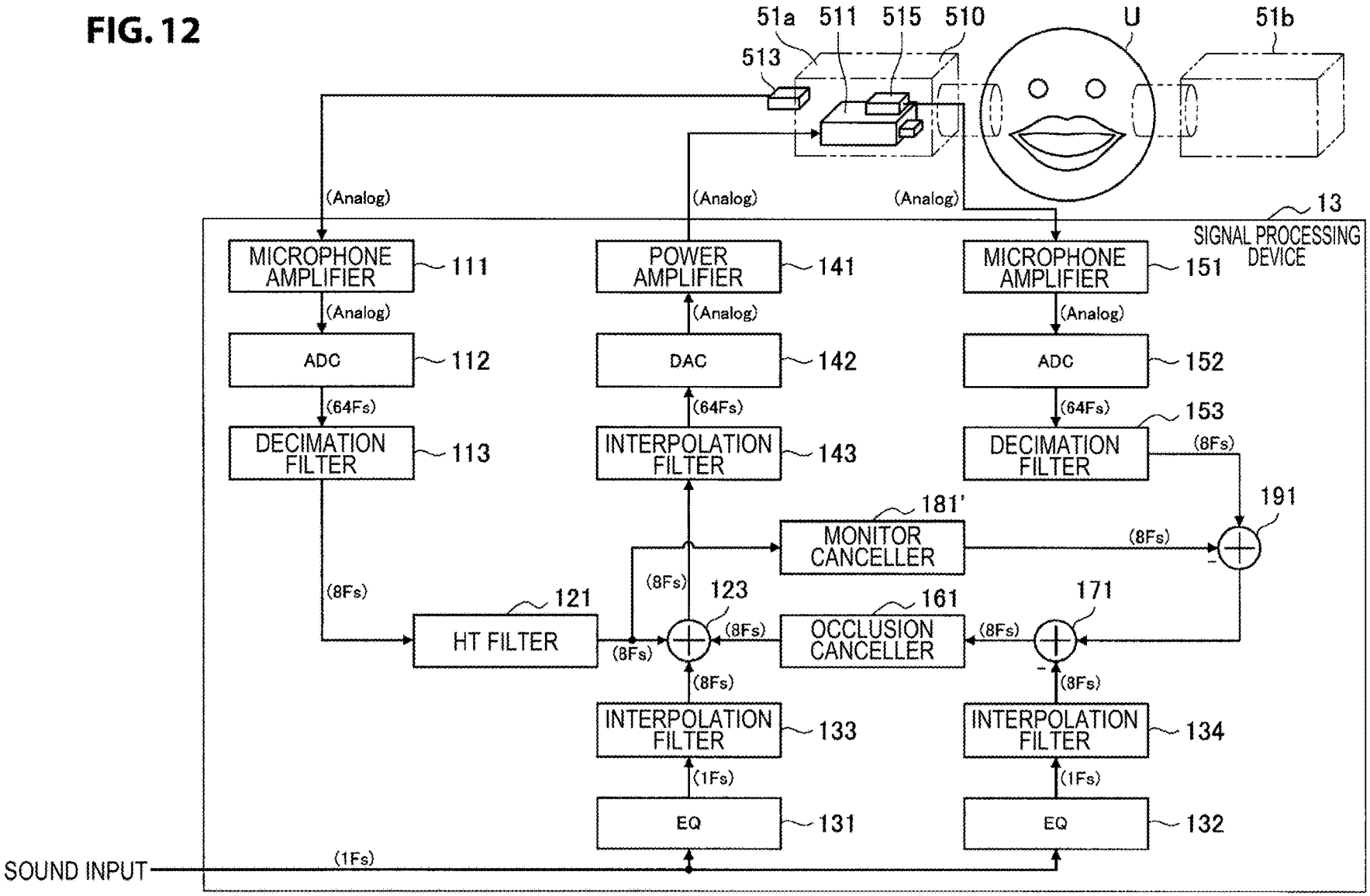
FIG. 12 is a block diagram illustrating an example of a functional configuration of a signal processing device according to a modified example of the embodiment.

Next, a modified example of the signal processing device 12 according to the present embodiment will be described with reference to FIG. 12. FIG. 12 is a block diagram illustrating an example of a functional configuration of a signal processing device according to a modified example of the present embodiment. The signal processing device according to the modified example is also referred to as a "signal processing device 13" to be distinguished from the signal processing device 12 according to the present embodiment described above with reference to FIGS. 9 and 10. In the example illustrated in FIG. 12, similarly to FIG. 10, the ADC and the DAC that perform the conversion process between the analog signal and the digital signal and the filter that converts the sampling rate of the digital signal are explicitly illustrated.

As illustrated in FIG. 12, the signal processing device 13 according to the modified example differs from the signal processing device 12 according to the above embodiment (see FIG. 10) in that a monitor canceller 181' is provided instead of the monitor canceller 181 illustrated in FIG. 12. Therefore, the present description will proceed, particularly, focusing on a configuration of the monitor canceller 181', and the remaining components are similar to those of the signal processing device 12 according to the above embodiment, and thus detailed description thereof is omitted.

As illustrated in FIG. 12, the monitor canceller 181' is positioned at a stage subsequent to the HT filter 121 and processes the difference signal output from the HT filter 121. Due to this configuration, the monitor canceller 181' need not perform the process related to the generation of the difference signal (that is, the process based on (Formula 2) and (Formula 3) described above, unlike the monitor canceller 181 described above with reference to FIG. 9.

In other words, the monitor canceller 181' performs the filter process based on the transfer function corresponding to each characteristic on the inputted difference signal so that the influences of the device characteristic of each of the power amplifier 141, the driver 511, and the microphone amplifier 151 and the spatial characteristic in the internal space are reflected.

The monitor canceller 181' outputs the difference signal which has undergone the filter process to the subtracting unit 191 positioned at a subsequent stage. A subsequent process is similar to that of the signal processing device 12 according to the above embodiment (see FIGS. 9 and 10).

With this configuration, the signal processing device 13 according to the modified example can communalize the process related to the generation of the difference signal in the HT filter 121 and the monitor canceller 181 of the signal processing device 12 illustrated in FIGS. 9 and 10 as the process of the HT filter 121. Therefore, as compared with the signal processing device 12 according to the above-described embodiment, the signal processing device 13 according to the modified example is able to reduce the resources for the calculation related to the generation of the difference signal, and thus it is possible to reduce the circuit size.

The signal processing device 13 according to the modified example of the present embodiment has been described above with reference to FIG. 12.

[4.4. Conclusion]

As described above, the signal processing device 12 according to the present embodiment subtracts the component corresponding to the difference signal from the acoustic signal based on the sound collection result of the internal microphone 515 in addition to the component of the sound input. With this configuration, in the signal processing device 12 according to the present embodiment, it is possible to exclude the component of the difference signal from the processing target from which the occlusion canceller 161 generates the noise reduction signal. In other words, in the signal processing device 12 according to the present embodiment, it is possible to prevent the component of the difference signal from being suppressed by the noise reduction signal. Therefore, the signal processing device 12 according to the present embodiment is able to implement the hear-through effect in a more natural manner (that is, a manner in which the user U has a less strange feeling) than in the signal processing device 11 according to the first embodiment.

<5. Third Embodiment>

Next, a signal processing device according to a third embodiment of the present disclosure will be described. As described above, in the signal processing device according to each embodiment of the present disclosure, the noise reduction signal for suppressing the voice component of the user propagating to the external ear canal UA is generated using the sound collection result of collecting the sound propagating in the internal space through the internal microphone 515. Due to this configuration, the acoustic signal based on the sound collection result of the internal microphone 515 (that is, the sound propagating in the internal space) includes the voice component (that is, the voice component of the user U propagating to the external ear canal UA via the bones or fresh of the head of the user U) as described above.

In this regard, in the present embodiment, an example of a signal processing device which is capable of using the voice component included in the acoustic signal based on the sound collection result obtained by the internal microphone 515 as a voice input (for example, a transmission signal in a voice call) will be described.

Figure 13:
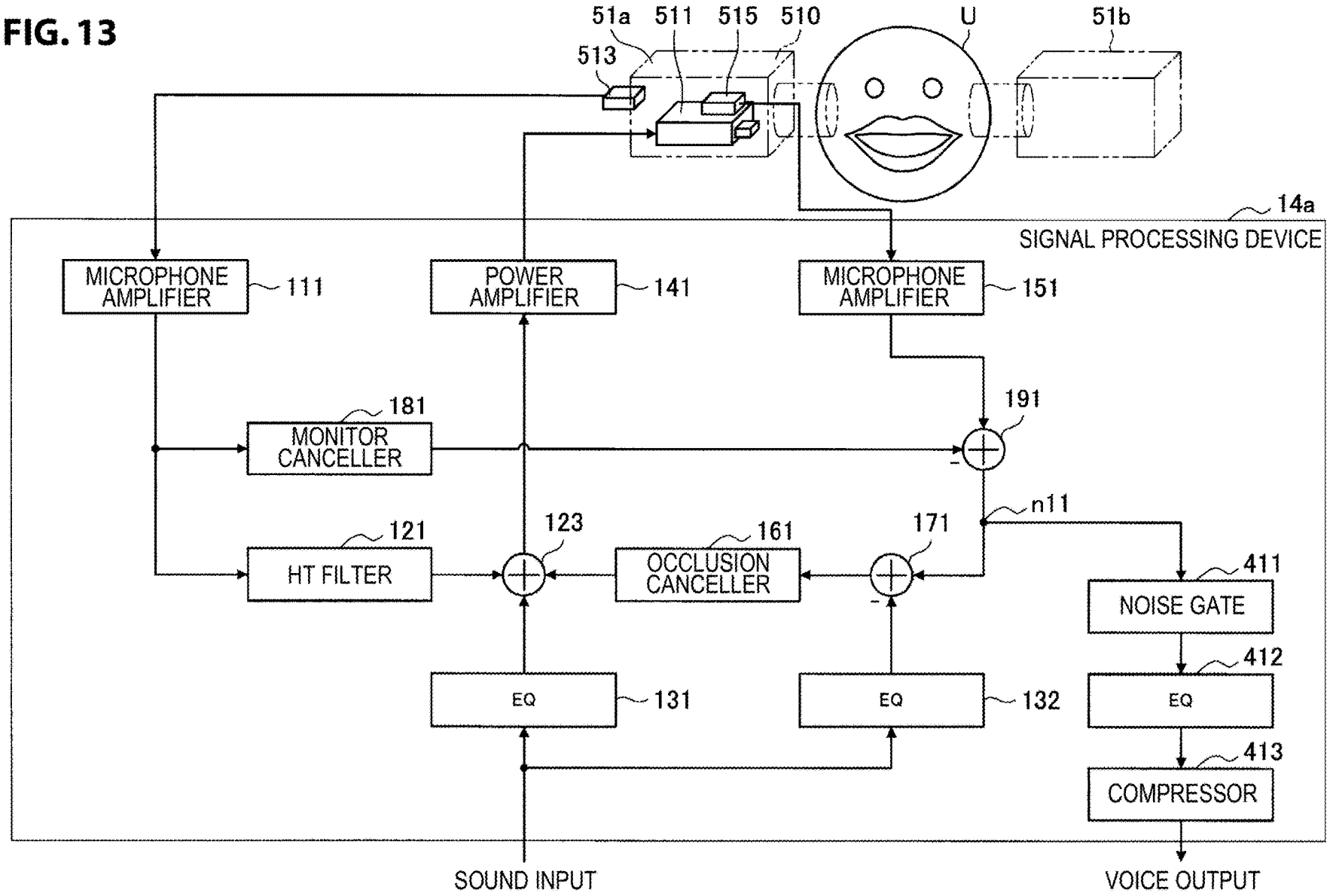
FIG. 13 is a diagram illustrating an example of a functional configuration of a signal processing device according to a third embodiment of the present disclosure.

For example, FIG. 13 is a block diagram illustrating an example of a functional configuration of a signal processing device according to the present embodiment. In the following description, the signal processing device illustrated in FIG. 13 is also referred to as a "signal processing device 14*a*" to be distinguished from the signal processing device according to each embodiment. Further, in the functional configuration illustrated in FIG. 13, illustration of the DAC and the ADC is omitted in order to facilitate understanding of the description.

As illustrated in FIG. 13, the signal processing device 14*a* according to the present embodiment differs from the signal processing device 13 according to the second embodiment (see FIG. 9) in that a noise gate 411, an EQ 412, and a compressor 413 are provided. In this regard, in the present description, the functional configuration of the signal processing device 14*a* according to the present embodiment will be described focusing on a difference with the signal processing device 13 according to the second embodiment, and thus detailed description of the remaining parts will be omitted.

As illustrated in FIG. 13, in the signal processing device 14*a*, at a node positioned at a stage subsequent to the subtracting unit 191 indicated by reference numeral n11 (that is, positioned between the subtracting unit 191 and the subtracting unit 171), an acoustic signal passing through the node n11 is split, and some split acoustic signals are input to the noise gate 411.

The noise gate 411 is a component for performing a so-called noise gate process on the input acoustic signal. Specifically, as the noise gate process, the noise gate 411 performs a process of lowering a level of an output signal at which a level of an input acoustic signal is equal to or less than a certain level (that is, closes a gate) and causing the level of the output signal to an original level (that is, opens the gate) if it exceeds the certain level. As is commonly performed, parameters in the noise gate process such as an attenuation rate of the output level, opening and closing envelopes of the gate, and a frequency band at which the gate responds are appropriately set so that an articulation rate of an uttered sound (that is, a voice component included in an input acoustic signal) is improved.

Then, the noise gate 411 outputs the acoustic signal which has undergone the noise gate process to the EQ 412 positioned at a subsequent stage.

The EQ 412 is a component for performing the equalizing process on the acoustic signal output from the noise gate 411. As described above, the low-frequency side of the voice component included in the acoustic signal split at the node n11 (that is, the acoustic signal based on the sound collection result of the internal microphone 515) is amplified, and the sound based on the acoustic signal (that is, the voice component) is heard by the listener as if it is muffled. For this reason, the EQ 412 improves the articulation rate of the sound to be heard by correcting the frequency characteristic of the acoustic signal so that the sound based on the acoustic signal is heard naturally by the listener (that is, so that a more natural frequency characteristic balance is obtained).

For example, the target characteristic that enables the EQ 412 to perform the equalizing process on the input acoustic signal may be decided on the basis of a result of a prior experiment or the like in advance.

Then, the EQ 412 outputs the acoustic signal which has undergone the equalizing process (that is, the acoustic signal including the voice component) to the compressor 413 positioned at a subsequent stage.

The compressor 413 is a component for performing a process for adjusting a time amplitude on the input acoustic signal as a so-called compressor process.

Specifically, as described above, the voice component included in the input acoustic signal propagates to the external ear canal UA via the bones or fresh of the head of the user U and causes the external ear canal wall to vibrate like a secondary speaker, and the vibration reaches the internal microphone 515 via the external ear canal UA. As described above, the propagation path in which the voice component reaches the internal microphone 515 has non-linearity slightly as compared with the air propagation such as the propagation in the external environment.

Therefore, a difference in a magnitude of an uttered voice which varies depending on a magnitude of a generated voice is larger than in a case in which a normal voice propagating via the air is collected, and thus the listener may be unable to hear the voice collected without change.

In this regard, the compressor 413 arranges a time axis amplitude of the acoustic signal based on the sound collection result obtained by the internal microphone 515 (specifically, the acoustic signal output from the EQ 412) so that the difference in the magnitude of the uttered voice is suppressed.

Then, the compressor 413 performs the compressor process on the input acoustic signal, and outputs the acoustic signal which has undergone the compressor process (that is, the acoustic signal including the voice component) as a voice signal.

The configuration of the signal processing device 14*a* illustrated in FIG. 13 is merely an example, and the configuration is not particularly limited as long as it is possible to output the acoustic signal including the voice component collected by the internal microphone 515 as the voice signal.

Figure 14:
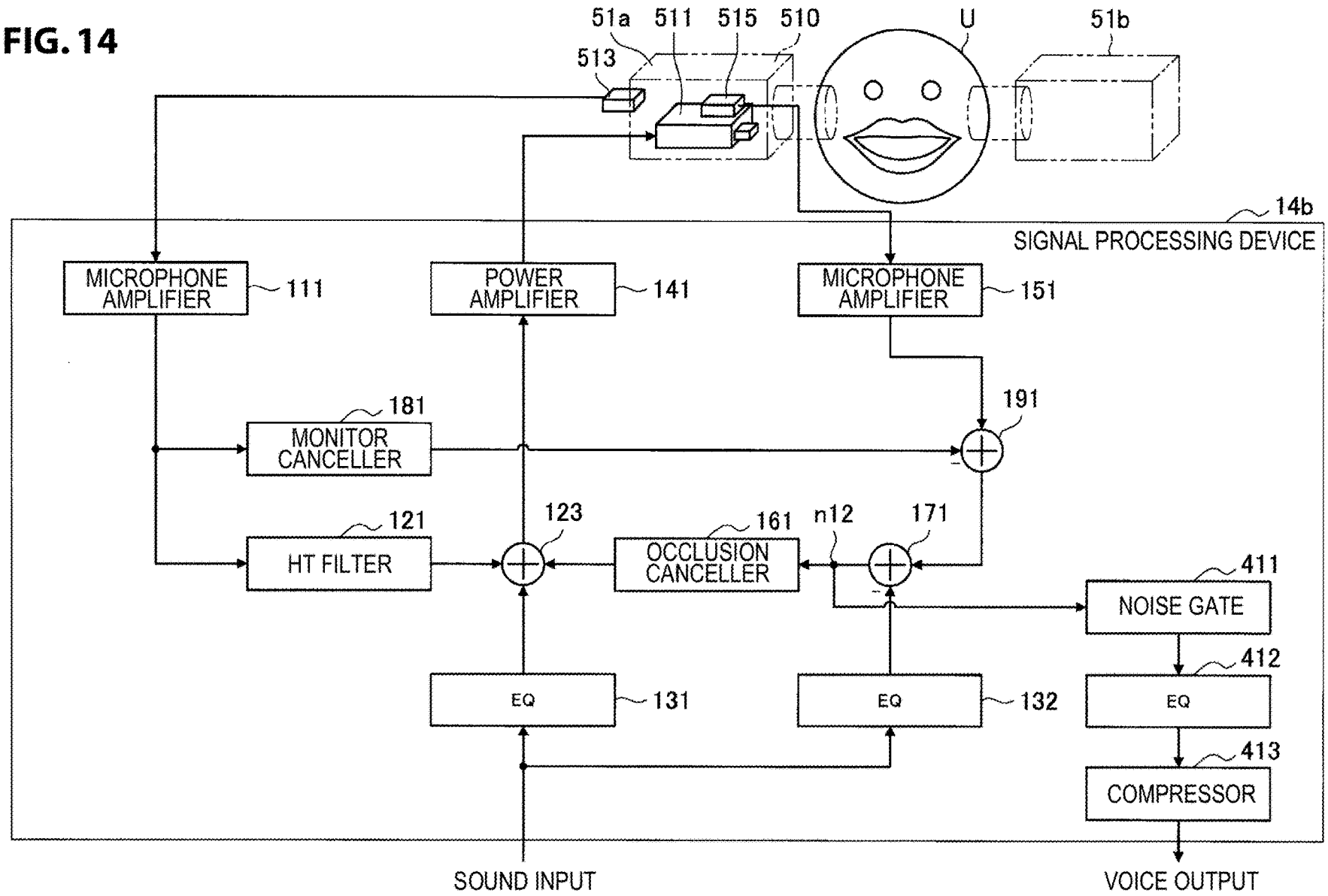
FIG. 14 is a block diagram illustrating another example of a functional configuration of the signal processing device according to the embodiment.

For example, FIG. 14 is a block diagram illustrating another example of a functional configuration of the signal processing device according to the present embodiment. In the following description, the signal processing device illustrated in FIG. 14 is also referred to as a "signal processing device 14*b*" to be distinguished from the signal processing device described above with reference to FIG. 13. Further, in the case in which the signal processing device illustrated in FIG. 14 is not distinguished from the signal processing device described above with reference to FIG. 13, it is also referred to simply as "signal processing device 14."

As illustrated in FIG. 14, in the signal processing device 14*b*, at a node positioned at the stage subsequent to the subtracting unit 171 indicated by reference numeral n12 (that is, positioned between the subtracting unit 171 and the occlusion canceller 161), an acoustic signal passing through the node n12 is split, and some split acoustic signals are input to the noise gate 411.

Here, the acoustic signal passing through the node n12 corresponds to an acoustic signal obtained by further subtracting the component of the sound input from the acoustic signal passing through the node n11. Therefore, in the signal processing device 14*b* illustrated in FIG. 14, it is possible to output the acoustic signal in which components other than the voice components are further suppressed in the acoustic signals based on the sound collection result of the internal microphone 515 as the voice signal as compared with the signal processing device 14*a* illustrated in FIG. 13.

The example of the functional configuration of the signal processing device 14 according to the present embodiment has been described above with reference to FIGS. 13 and 14.

As described above, in the signal processing device 14 according to the present embodiment, the acoustic signal obtained by subtracting the difference signal from the acoustic signal based on the sound collection result of the internal microphone 515 through the subtracting unit 191 is output as the voice signal. With this configuration, the acoustic signal in which the component corresponding to the ambient sound among the components included in the acoustic signal based on the sound collection result of the internal microphone 515 is suppressed is output as the voice signal. In other words, according to the signal processing device 14 of the present embodiment, it is possible to acquire a voice input having a higher S/N ratio (that is, a smaller noise) than in the case of collecting the voice of the user U using a microphone or the like in the external environment.

Figure 15:
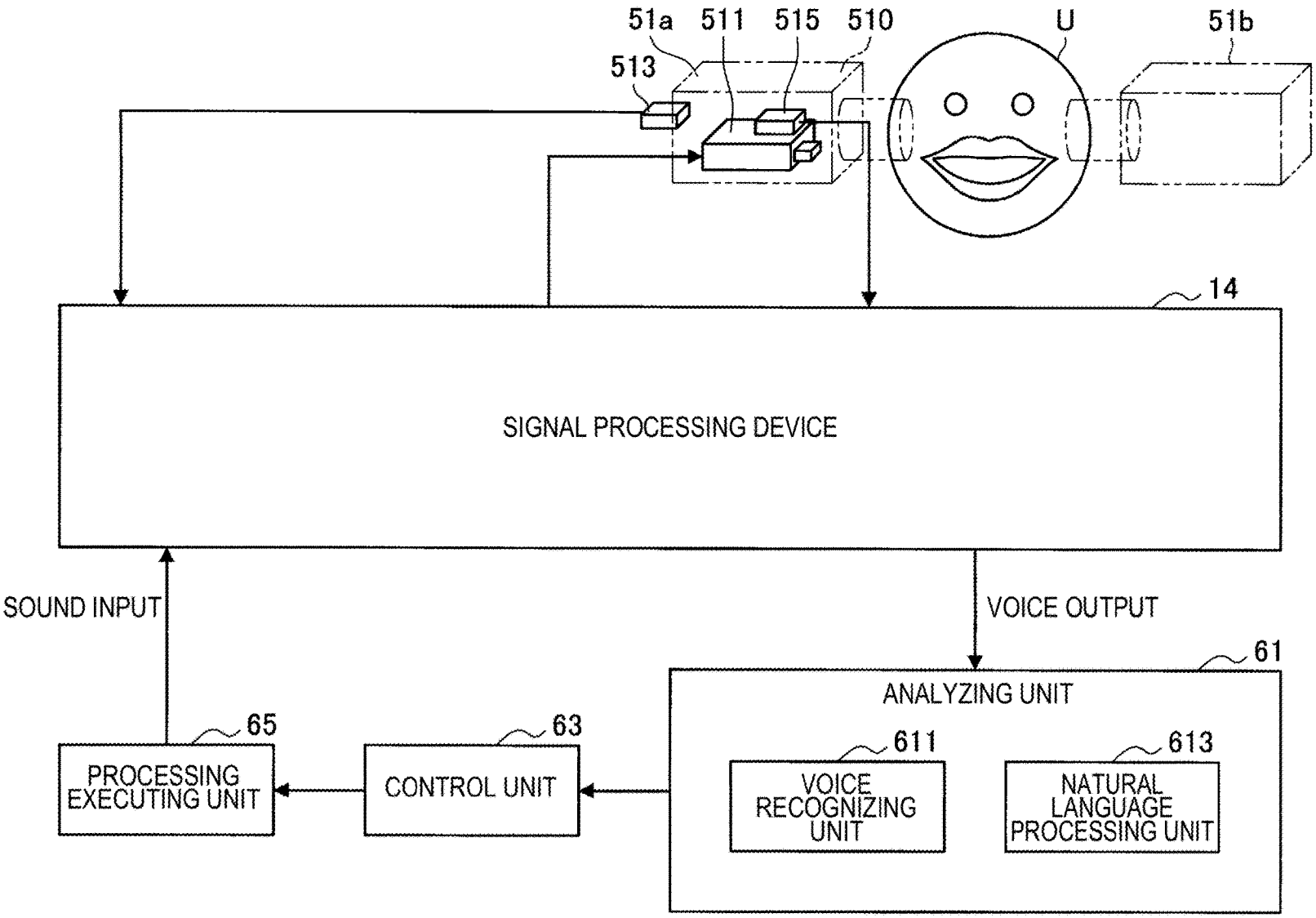
FIG. 15 is an explanatory diagram for describing an application example of a signal processing device according to the embodiment.

Next, an application example of the signal processing device 14 according to the present embodiment will be described with reference to FIG. 15. FIG. 15 is an explanatory diagram for describing an application example of the signal processing device 14 according to the present embodiment. Specifically, FIG. 15 illustrates an example of a functional configuration of an information processing system which is capable of executing various kinds of processes on the basis of instruction content indicated by the voice input by using the voice signal output from the signal processing device 14 as the voice input.

The information processing system illustrated in FIG. 15 includes a head mounted acoustic device 51, a signal processing device 14, an analyzing unit 61, a control unit 63, and a processing executing unit 65. Since the head mounted acoustic device 51 and the signal processing device 14 are similar to those in the example illustrated in FIG. 13 or FIG. 14, detailed description thereof will be omitted.

The analyzing unit 61 is a component for acquiring the voice signal (that is, the voice output) output from the signal processing device 14 as the voice input and performing various kinds of analysis on the voice input so that the control unit 63 to be described later is able to recognize content indicated by the voice input (that is, the instruction content given from the user U). The analyzing unit 61 includes a voice recognizing unit 611 and a natural language processing unit 613.

The voice recognizing unit 611 converts the voice input acquired from the signal processing device 14 into character information by analyzing the voice input on the basis of a so-called voice recognition technique. Then, the voice recognizing unit 611 outputs a result of analysis based on the voice recognition technique, that is, the character information obtained by converting the voice input to the natural language processing unit 613.

The natural language processing unit 613 acquires the character information obtained by converting the voice input from the voice recognizing unit 611 as the result of analyzing the voice input obtained from the signal processing device 14 on the basis of the voice recognition technique. The natural language processing unit 613 performs analysis based on a so-called natural language processing technique (for example, lexical analysis (morphological analysis), syntax analysis, semantic analysis, or the like) on the acquired character information.

Then, the natural language processing unit 613 outputs information indicating a result of performing natural language processing on the character information obtained by converting the voice input acquired from the signal processing device 14 to the control unit 63.

The control unit 63 acquires information indicating a result of analyzing the voice input acquired from the signal processing device 14 (that is, a result of performing natural language processing on the character information obtained by converting the voice input) from the analyzing unit 61. The control unit 63 recognizes the instruction content given from the user U which is based on the voice input on the basis of the acquired analysis result.

The control unit 63 specifies a target function (for example, an application) on the basis of the recognized instruction content given from the user U and instructs the processing executing unit 65 to execute the specified function.

The processing executing unit 65 is a component for executing various kinds of functions. On the basis of the instruction given from the control unit 63, The processing executing unit 65 reads various kinds of data for executing a target function (for example, a library for executing an application or data of content) and executes the function on the basis of the read data. Further, a storage destination of data for executing various kinds of functions through the processing executing unit 65 is not particularly limited as long as the data is stored at a position at which it is readable by the processing executing unit 65.

At this time, the processing executing unit 65 may also input acoustic information based on a result of executing the function instructed from the control unit 63 (for example, audio content reproduced on the basis of an instruction) to the signal processing device 14. As another example, the processing executing unit 65 may generate voice information indicating content to be presented to the user U on the basis of the result of executing the function instructed from the control unit 63 on the basis of a so-called voice synthesis technique and input the generated audio information to the signal processing device 14. With this configuration, the user U is able to recognize results of executing various kinds of functions on the basis of the instruction content given from the user U as the acoustic information (voice information) output through the head mounted acoustic device 51.

In other words, according to the information processing system illustrated in FIG. 15, the user U is able to instruct the information processing system to execute various kinds of functions by voice in the state in which the user UE wear the head mounted acoustic device 51 and hear the acoustic information based on the result of executing the functions through the head mounted acoustic device 51.

As a specific example, the user U is able to give an instruction to reproduce desired audio content by voice and hear a result of reproducing audio content through the head mounted acoustic device 51.

As another example, the user is able to instruct the information processing system to read desired character information (for example, a delivered e-mail, news, information uploaded to a network, or the like) and hear a result of reading the character information through the head mounted acoustic device 51.

As another example, the information processing system illustrated in FIG. 15 may be used for a so-called voice call. In this case, the voice signal output from the signal processing device 14 may be used as a transmission signal, and a received signal may be input to the signal processing device 14 as the sound input.

The configuration of the information processing system illustrated in FIG. 15 is merely an example, and the configuration illustrated in FIG. 15 is not necessarily limited as long as it is possible to implement the processes of the components of the information processing system described above. As a specific example, at least some of the analyzing unit 61, the control unit 63, and the processing executing unit 65 may be installed in an external device (for example, a server) connected via a network.

The example of the functional configuration of the information processing system using the voice signal output from the signal processing device 14 as the voice input has been described above with reference to FIG. 15 as the application example of the signal processing device 14 according to the present embodiment.

<6. Hardware Configuration>

Figure 16:
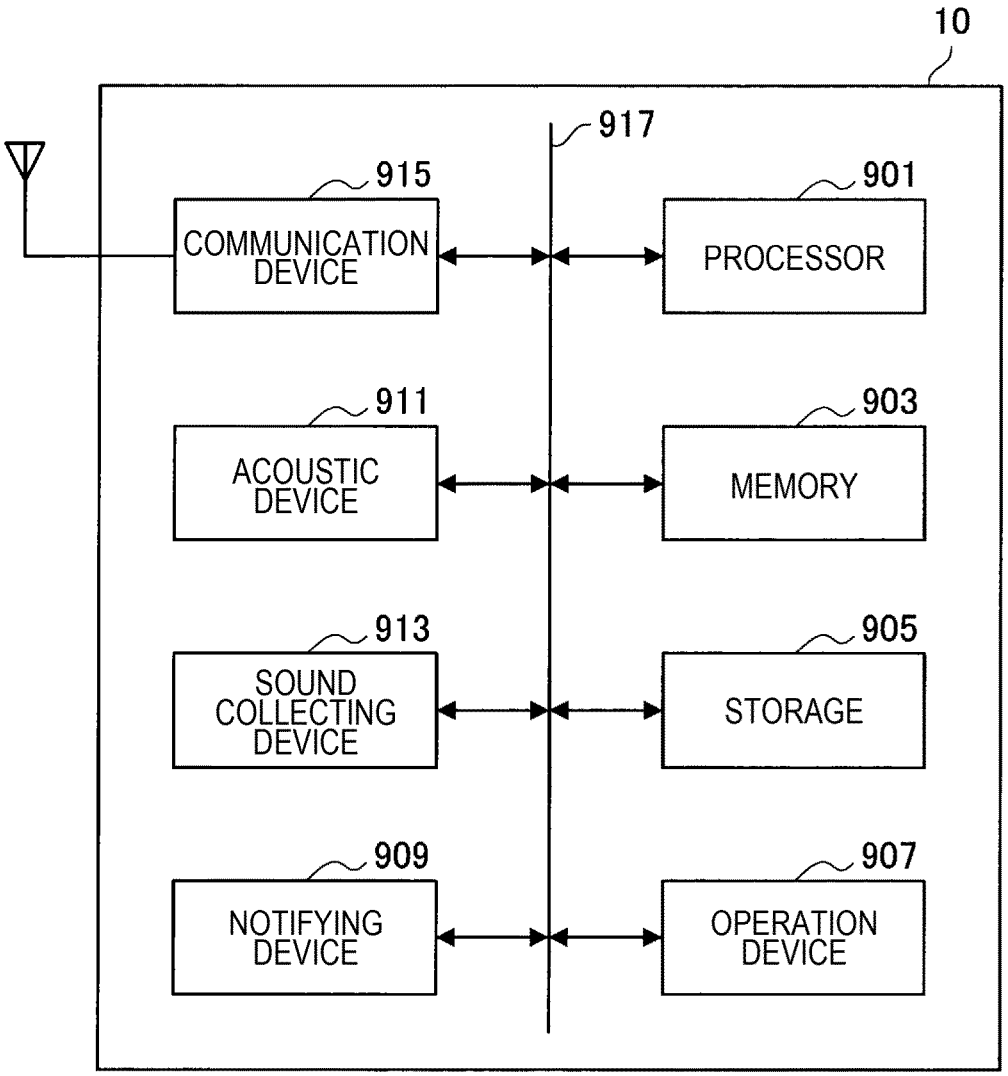
FIG. 16 is a diagram illustrating an example of a hardware configuration of a signal processing device according to embodiments of the present disclosure.

Next, an example of a hardware configuration of a signal processing device 10 according to each embodiment of the present disclosure (that is, the signal processing devices 11 to 14) will be described with reference to FIG. 16. FIG. 16 is a diagram illustrating an example of the hardware configuration of the signal processing device 10 according to each embodiment of the present disclosure.

As illustrated in FIG. 16, the signal processing device 10 according to the present embodiment includes a processor 901, a memory 903, a storage 905, an operation device 907, a notifying device 909, an acoustic device 911, a sound collecting device 913, and a bus 917. Further, the signal processing device 10 may include a communication device 915.

The processor 901 may be, for example, a central processing unit (CPU), a graphics processing unit (GPU), a digital signal processor (DSP), or a system on chip (SoC), and executes various processes of the signal processing device 10. The processor 901 may be constituted by, for example, an electronic circuit that executes various kinds of calculation processes. The components of the signal processing devices 11 to 14 (particularly, the HT filter 121, the occlusion canceller 161, the monitor canceller 181, or the like) may be implemented by the processor 901.

The memory 903 includes a random access memory (RAM) and a read only memory (ROM), and stores programs and data executed by the processor 901. The storage 905 may include a storage medium such as a semiconductor memory or a hard disk.

The operation device 907 has a function of generating an input signal that enables the user to perform a desired operation. The operation device 907 may be configured as, for example, a touch panel. As another example, the operation device 907 may be configured with an input unit that enables the user to input information such as a button, a switch, and a keyboard, an input control circuit that generates an input signal on the basis of an input performed by the user and supplies the input signal to the processor 901, and the like.

The notifying device 909 is an example of an output device and may be a device such as a liquid crystal display (LCD) device, an organic EL (organic light emitting diode) display, or the like. In this case, the notifying device 909 is able to notify the user of predetermined information by displaying a screen.

The example of the notifying device 909 described above is merely an example, and a form of the notifying device 909 is not particularly limited as long as it is possible to notify the user of predetermined information. As a specific example, the notifying device 909 may be a device that notifies the user predetermined information by means of a lighting or blinking pattern such as a light emitting diode (LED). Further, the notifying device 909 may be a device that notifies the user of predetermined information through vibration such as a so-called vibrator.

The acoustic device 911 is a device that notifies the user of predetermined information by outputting a predetermined acoustic signal as in a speaker or the like. In the head mounted acoustic device 51, particularly, the speaker driven by the driver 511 may be configured with the acoustic device 911.

The sound collecting device 913 is a device that collects a voice uttered by the user or a sound coming from a surrounding environment and acquires them as acoustic information (acoustic signal) as in a microphone. Further, the sound collecting device 913 may acquire data indicating an analogue acoustic signal indicating the collected voice or sound as the acoustic information or may convert the analog acoustic signal into a digital acoustic signal, and acquire data indicating the converted digital acoustic signal as the acoustic information. Each of the external microphone 513 and the internal microphone 515 in the head mounted acoustic device 51 described above may be implemented by the sound collecting device 913.

The communication device 915 is a communication unit installed in the signal processing device 10, and performs communication with an external device via a network. The communication device 915 is a communication interface for wired or wireless communication. In a case in which the communication device 915 is configured as a wireless communication interface, the communication device 915 may include a communication antenna, a radio frequency (RF) circuit, a baseband processor, and the like.

The communication device 915 has a function of performing various kinds of signal processing on a signal received from the external device and is able to supply a digital signal generated from the received analog signal to the processor 901.

The bus 917 connects the processor 901, the memory 903, the storage 905, the operation device 907, the notifying device 909, the acoustic device 911, the sound collecting device 913, and the communication device 915 with one another. The bus 917 may include a plurality of types of buses.

Further, it is also possible to create a program causing hardware such as a processor, a memory, and a storage which are installed in a computer to perform functions similar to those of the components of the signal processing device 10. Further, a computer readable storage medium having the program stored therein may also be provided.

<7. Conclusion>

As described above, the signal processing device 10 according to each embodiment of the present disclosure (that is, the signal processing devices 11 to 14 described above) generates the difference signal on the basis of the sound collection result for the ambient sound propagating in the external space outside the mounting unit 510 of the head mounted acoustic device 51. Further, the signal processing device 10 generates the noise reduction signal for suppressing the voice component propagating to the internal space on the basis of the sound collection result for the sound propagating to the internal space inside the mounting unit 510. Then, the signal processing device 10 adds the generated difference signal and the noise reduction signal to the input sound input, and outputs the acoustic signal generated on the basis of the addition result to the driver 511 of the head mounted acoustic device 51. Accordingly, the driver 511 is driven in accordance with the acoustic signal, and the sound based on the acoustic signal is radiated into the internal space.

With this configuration, the component of the difference signal included in the sound radiated into the internal space and the ambient sound propagating to the internal space via the mounting unit 510 (that is, the sound propagating via the propagation environment F in FIGS. 2 and 3) are added in the internal space, and the addition result is heard by the user U, and thus the hear-through effect can be implemented. Further, the noise reduction signal included in the sound radiated into the internal space and the voice component propagating to the external ear canal UA via the bones or fresh of the head of the user U are added, and the addition result is heard by the user U, and thus the user U is able to hear his/her voice in a more natural manner (that is, the user U has no strange feeling).

A series of processes (that is, signal processing such as various kinds of filter processes) executed by the signal processing device 10 according to each embodiment of the present disclosure described above corresponds to an example of a "signal processing method."

The preferred embodiment(s) of the present disclosure has/have been described above with reference to the accompanying drawings, whilst the present disclosure is not limited to the above examples. A person skilled in the art may find various alterations and modifications within the scope of the appended claims, and it should be understood that they will naturally come under the technical scope of the present disclosure.

Further, the effects described in this specification are merely illustrative or exemplified effects, and are not limitative. That is, with or in the place of the above effects, the technology according to the present disclosure may achieve other effects that are clear to those skilled in the art from the description of this specification.

Additionally, the present technology may also be configured as below.

(1)

A signal processing device, including:

a first acquiring unit configured to acquire a sound collection result for a first sound propagating in an external space outside a mounting unit to be worn on an ear of a listener;

a second acquiring unit configured to acquire a sound collection result for a second sound propagating in an internal space connected with an external ear canal inside the mounting unit;

a first filter processing unit configured to generate a difference signal which is substantially equal to a difference between the first sound propagating directly from the external space toward an inside of the external ear canal and the first sound propagating from the external space to the internal space via the mounting unit on the basis of the sound collection result for the first sound;

a subtracting unit configured to generate a subtraction signal obtained by subtracting a first signal component based on the sound collection result for the first sound and a second signal component based on an input acoustic signal to be output from an acoustic device from an inside of the mounting unit toward the internal space from the sound collection result for the second sound;

a second filter processing unit configured to generate a noise reduction signal for reducing the subtraction signal on the basis of the subtraction signal; and an adding unit configured to add the difference signal and the noise reduction signal to the input acoustic signal to generate a drive signal for driving the acoustic device.

(2)

The signal processing device according to (1), including:

a third filter processing unit configured to apply, to the acoustic signal based on the sound collection result for the first sound, a characteristic corresponding to at least a transfer function of a route on which the acoustic signal output from the acoustic device is collected as the second sound via the internal space, and output the acoustic signal based on the sound collection result for the first sound as the first signal component.

(3)

The signal processing device according to (2), in which the third filter processing unit generates the first signal component using the sound collection result for the first sound as an input signal.

(4)

The signal processing device according to (2), in which the third filter processing unit generates the first signal component using the difference signal output from the first filter processing unit as an input signal.

(5)

The signal processing device according to any one of (2) to (4), in which the third filter processing unit includes a fourth filter processing unit configured to process a delay component in the acoustic signal based on the input sound collection result for the first sound and a fifth filter processing unit configured to process a frequency component.

(6)

The signal processing device according to (5), in which the fourth filter processing unit includes an infinite impulse response filter.

(7)

The signal processing device according to (5) or (6), in which the fifth filter processing unit includes a finite impulse response filter.

(8)

The signal processing device according to any one of (1) to (7), including: a first equalization processing unit configured to equalize the input acoustic signal to a first target characteristic and output the equalized acoustic signal to the adding unit; and a second equalization processing unit configured to equalize the input acoustic signal to a second target characteristic and output the equalized acoustic signal to the subtracting unit as the second signal component.

(9)

The signal processing device according to any one of (1) to (8), including: a voice signal output unit configured to output a signal component based on a result of subtracting the first signal component from the sound collection result for the second sound as a voice signal.

(10)

The signal processing device according to (9), in which the voice signal output unit outputs the subtraction signal as the voice The signal processing device according to any one of (1) to (10), including:

at least one of a first sound collecting unit configured to collect the first sound and a second sound collecting unit configured to collect the second sound.

(12)

The signal processing device according to any one of (1) to (11), including:

the acoustic device.

(13)

A signal processing device, including:

an acquiring unit configured to acquire a sound collection result for a sound propagating in an external space outside a mounting unit to be worn on an ear of a listener;

a filter processing unit configured to generate a difference signal which is substantially equal to a difference between the sound directly propagating from the external space toward an inside of an external ear canal and the sound propagating from the external space to the inside of the external ear canal via the mounting unit on the basis of the sound collection result for the sound; and an adding unit configured to add the difference signal to an input acoustic signal to be output from an acoustic device from an inside of the mounting unit toward the inside of the external ear canal to generate a drive signal for driving the acoustic device, in which a delay amount before the sound propagating in the external space is collected, and then the sound based on the drive signal obtained by adding the difference signal based on the sound is output from the acoustic device is 100 μs or less.

(14)

The signal processing device according to (13), including:

an AD converting unit configured to perform AD conversion of converting the sound collection result for the sound propagating in the external space into a first digital signal at a first sampling rate;

a decimation filter configured to generate a second digital signal by down-sampling the first digital signal to a third sampling rate which is lower than the first sampling rate and higher than a second sampling rate for sampling the input acoustic signal;

an interpolation filter configured to up-sample the digital signal sampled at the third sampling rate to the first sampling rate; and a DA converting unit configured to perform DA conversion of converting an output result of the interpolation filter into an analog acoustic signal, in which the filter processing unit generates the difference signal using the second digital signal as an input signal.

(15)

A signal processing method, including, by a processor:

acquiring a sound collection result for a first sound propagating in an external space outside a mounting unit to be worn on an ear of a listener;

acquiring a sound collection result for a second sound propagating in an internal space connected with an external ear canal inside the mounting unit;

generating a difference signal which is substantially equal to a difference between the first sound propagating directly from the external space toward an inside of the external ear canal and the first sound propagating from the external space to the internal space via the mounting unit on the basis of the sound collection result for the first sound;

generating a subtraction signal obtained by subtracting a first signal component based on the sound collection result for the first sound and a second signal component based on an input acoustic signal to be output from an acoustic device from an inside of the mounting unit toward the internal space from the sound collection result for the second sound;

generating a noise reduction signal for reducing the subtraction signal on the basis of the subtraction signal; and adding the difference signal and the noise reduction signal to the input acoustic signal and to generate a drive signal for driving the acoustic device.

(16)

A program causing a computer to execute:

acquiring a sound collection result for a first sound propagating in an external space outside a mounting unit to be worn on an ear of a listener;

acquiring a sound collection result for a second sound propagating in an internal space connected with an external ear canal inside the mounting unit;

generating a difference signal which is substantially equal to a difference between the first sound propagating directly from the external space toward an inside of the external ear canal and the first sound propagating from the external space to the internal space via the mounting unit on the basis of the sound collection result for the first sound;

generating a subtraction signal obtained by subtracting a first signal component based on the sound collection result for the first sound and a second signal component based on an input acoustic signal to be output from an acoustic device from an inside of the mounting unit toward the internal space from the sound collection result for the second sound;

generating a noise reduction signal for reducing the subtraction signal on the basis of the subtraction signal; and adding the difference signal and the noise reduction signal to the input acoustic signal and to generate a drive signal for driving the acoustic device.

REFERENCE SIGNS LIST

11 to 14 signal processing device
111 microphone amplifier
113 decimation filter
121 HT filter
123 adding unit
133 interpolation filter
134 interpolation filter
141 power amplifier
143 interpolation filter
151 microphone amplifier
153 decimation filter
161 occlusion canceller
171 subtracting unit
181 monitor canceller
183 decimation filter
184 IIR filter
185 FIR filter
186 interpolation filter
191 subtracting unit
411 noise gate
412 EQ
413 compressor
51 head mounted acoustic device
510 mounting unit
511 driver
513 external microphone
515 internal microphone
61 analyzing unit
611 voice recognizing unit
613 natural language processing unit
63 control unit
65 processing executing unit

The invention claimed is:

1. An ambient sound hearing device, comprising:

a mounting unit configured to be mounted in an ear canal;

a microphone configured to be arranged outside the ear canal on the mounting unit and configured to collect an ambient sound;

a digital filter processor configured to generate an output signal by performing digital signal processing on a digital input signal derived from the ambient sound collected by the microphone; and a speaker configured to be arranged inside the ear canal on the mounting unit and configured to generate an output sound based on the output signal generated by the digital filter processor, wherein the output sound combined with the ambient sound is equivalent to sound that would have reached the ear canal in the absence of the mounting unit, wherein a delay between the microphone collecting the ambient sound and the speaker generating the output sound is 100 μs or less, wherein the digital filter processor is further configured to perform the digital signal processing based on a filter coefficient, and wherein the digital filter processor is further configured to generate a difference signal which, when added to the ambient sound, represents the sound that would have reached the ear canal in the absence of the mounting unit.

2. The ambient sound hearing device according to claim 1, wherein the filter coefficient is determined based on a pre-defined formula.

3. The ambient sound hearing device according to claim 1, wherein the digital filter processor is a Digital Signal Processor (DSP).

4. The ambient sound hearing device according to claim 1, wherein the digital filter processor is a System on Chip (SoC).

5. The ambient sound hearing device according to the claim 1, wherein the ambient sound hearing device implements a hear-through effect.

6. The ambient sound hearing device according to the claim 1, further comprising:

an ADC configured to convert the ambient sound collected by the microphone into a digital signal;

a DAC configured to convert the output signal produced by the digital signal processor into an analog signal; and a power amplifier configured to perform a gain adjustment on the analog signal to generate the output sound at the speaker.

* * * * *